US006382775B1

(12) United States Patent
Kubota et al.

(10) Patent No.: US 6,382,775 B1
(45) **Date of Patent: *May 7, 2002**

(54) LIQUID EJECTING PRINTING HEAD, PRODUCTION METHOD THEREOF AND PRODUCTION METHOD FOR BASE BODY EMPLOYED FOR LIQUID EJECTING PRINTING HEAD

(75) Inventors: Masahiko Kubota, Tokyo; Hiroshi Sugitani, Machida; Shigeyuki Matsumoto, Atsugi; Masami Ikeda, Yokohama; Yasuhiro Naruse, Kiyokawa-mura; Kenji Makino; Teruo Ozaki, both of Yokohama; Masaaki Okada, Sanjoh; Seiichi Tamura, Atsugi, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/671,368

(22) Filed: Jun. 27, 1996

(30) Foreign Application Priority Data

Jun. 28, 1995 (JP) ..... 7-162465
Jun. 27, 1996 (JP) ..... 8-167657

(51) Int. Cl.[7] ..... B41J 2/05
(52) U.S. Cl. ..... 347/62; 347/64
(58) Field of Search ..... 347/59, 57, 56, 347/62, 64; 437/194, 196; 427/569–579

(56) References Cited

U.S. PATENT DOCUMENTS 4,313,124 A 1/1982 Hara
4,345,262 A 8/1982 Shirato et al.
4,424,520 A * 1/1984 Matsuda et al.
4,459,600 A 7/1984 Sato et al.
4,463,359 A 7/1984 Ayata et al.

(List continued on next page.)

FOREIGN PATENT DOCUMENTS

| | | | | |
|---|---|---|---|---|
| EP | 336672 A2 | * | 10/1989 | |
| EP | 518467 A2 | * | 12/1992 | |
| EP | 539804 A2 | * | 5/1993 | |
| EP | 0 630 752 A2 | | 12/1994 | |
| EP | 641658 A2 | * | 3/1995 | |
| JP | 54-56847 | | 5/1979 | |
| JP | 57-72867 | | 5/1982 | |
| JP | 59-123670 | | 7/1984 | |
| JP | 59-138461 | | 8/1984 | |
| JP | 60-71260 | | 4/1985 | |
| JP | 1-259957 | * | 12/1988 | ..... B41J/3/04 |
| JP | 401259957 | * | 10/1989 | ..... 347/62 |

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A printing head is intended to achieve high reliability and a production method of the printing head is intended to achieve high yield at low cost. A liquid ejecting printing head employs a base body, in which an electrothermal transducer element, a driving functional element for driving the electrothermal transducer element, a wiring electrode connecting between the electrothermal transducer element and the driving functional element, and an insulation layer provided on the wiring electrode are formed on a substrate. The electrothermal transducer element has a heat generating resistor formed of a material selected from the group consisting TaN, $HfB_2$, Poly-Si, Ta—Al, Ta—Ir, Au and Ag. A protective layer above the heat generating body is formed of an insulative compound deposited to be low density to high density in order. The protective layer is formed by depositing the insulative material in the electrothermal transducer element or the wiring electrode with elevating the temperature of the base body from low temperature to high temperature.

18 Claims, 19 Drawing Sheets

U.S. PATENT DOCUMENTS 4,558,333 A 12/1985 Sugitani et al.
4,608,577 A 8/1986 Hori
4,663,640 A 5/1987 Ikeda
4,723,129 A 2/1988 Endo et al.
4,740,796 A 4/1988 Endo et al.
5,045,870 A * 9/1991 Lamey et al. ..... 347/59
5,157,419 A * 10/1992 Matsumoto et al.
5,169,806 A * 12/1992 Hawkins et al. ..... 437/233
5,268,208 A * 12/1993 Krisko et al. ..... 427/576
5,376,231 A * 12/1994 Matsumoto et al. ..... 156/656
5,484,075 A * 1/1996 Kimura et al. ..... 216/27
5,517,224 A * 5/1996 Kaizu et al. ..... 347/59
5,643,638 A * 7/1997 Otto et al. ..... 427/569

* cited by examiner

LIQUID EJECTING PRINTING HEAD, PRODUCTION METHOD THEREOF AND PRODUCTION METHOD FOR BASE BODY EMPLOYED FOR LIQUID EJECTING PRINTING HEAD

BACKGROUND OF THE INVENTION

1. Field of the Invention

The present invention relates to a production method for a base body for a liquid ejecting printing head (hereinafter simply referred to as "printing head"), in which an electrothermal transducer and printing functional elements are formed on a substrate, and a production method for a printing head employing the base body for the printing head, and more particularly to a production method for a printing head employing the base body for a printing head to be employed in an ink-jet printing apparatus adapted to be used in a copy machine, facsimile, wordprocessor, or printer as an output device of a host computer, video output printer and so forth.

2. Description of the Related Art

Conventionally, the printing head is constructed by forming an electrothermal transducer element on a monocrystalline substrate, arranging a functional element for driving the electrothermal transducer element, a transistor array and so forth, outside of the silicon substrate, as a driver circuit for the electrothermal transducer element and connecting between the electrothermal transducer element and the transistor array by means of a flexible cable or wired bonding and so forth.

For the purpose of simplification of construction, reducing faulty product to be caused during production process and improvement for uniformity and reproductivity of characteristics of respective elements to be considered in head construction, there has been known an ink-jet printing apparatus having a printing head, in which the electrothermal transducer element and the functional element are formed on a common substrate, have been proposed in Japanese Patent Application Laid-open No. 72867/1982.

FIG. 1 is a section showing a part of the base body for the printing head constructed as set forth above. In FIG. 1, reference numeral 1801 denotes a semiconductor substrate of monocrystalline silicon. Reference numeral 1804 denotes an N-type semiconductor epitaxial region; and 1811 denotes an ohmic contact region of an N-type semiconductor with high impurity concentration. Reference numeral 1805 denotes a P-type semiconductor base region, and 1810 denotes an emitter region of a high impurity concentration N-type semiconductor. These regions form a bipolar transistor. Reference numeral 1816 denotes a silicon oxide layer as a heat accumulation layer and an interlayer insulation layer. Reference numeral 1817 denotes a heat generating resistor layer, 1818 denotes a wiring electrode of aluminum (Al), 1819 denotes a silicon oxide layer as a protective layer, 1812 denotes a base-collector common electrode of Al and 1820 denotes a Ta layer as a protective layer. These form the base body for the printing head including the electrothermal transducer. Here, reference numeral 1822 denotes a heat generating portion. The printing head is constructed as by forming an upper plate and a liquid passage on the base body constructed as set forth above.

On the other hand, while the construction set forth above is superior, there still exists room for improvement in satisfying high speed driving, energy saving, high package density, low cost, and high reliability which are strongly demanded for the recent printing apparatus.

At first, it is required to provide highly reliable printing head at low price. For achieving this, it becomes necessary to produce the printing head at satisfactorily high yield. Namely, conventional interlayer insulation layer 1816 and the protective layer 1819 and so forth are formed by depositing BPSG, SiO, $SiO_2$, SiON, SiN and so forth at 300 to 450° C. employing layer forming technology, such as normal pressure CVD, PE-CVD and so forth. However, in such temperature, wiring of Al or so forth or electrode or so forth causes a buno shaped bulge (often in the extent of 2 $\mu$m in height and diameter) of Al or so forth called as hillock layer deposited (grown) by plasma CVD method and sputtering method, as shown in FIG. 2, for example, and grown. Then, by unevenness of the hillock 1101 and 1102, shorting is caused between wiring electrodes and between wiring and the protective layer of Ta (see protective layer 1820 shown in FIG. 1, for example) to result in operation failure to lower yield in production.

Therefore, it is a belief of the inventors that improvement of yield in production of the base body can be achieved by restricting growth of hillock in layer deposition by plasma CVD method and sputtering method.

SUMMARY OF THE INVENTION

Therefore, it is an object of the present invention to solve the above-mentioned technical problem and thus to provide a production method of a base body for a highly reliable printing head and the printing head at low cost and high yield. A protection method of a base body for a liquid ejecting printing head, according to the present invention, including an electrothermal transducer element for generating a thermal energy to be used in liquid ejection, a driving functional element driving the electrothermal transducer element, a plurality of wiring electrodes for connecting the driving functional element and the electrothermal transducer element, is characterized in that the protective layer is formed by depositing an insulative material over the electrothermal transducer element or the wiring electrode with elevating a temperature of the base body.

In such case, the base body temperature at a low temperature in the foregoing step is in a range of 200° C. to 300° C. and at a high temperature is in a range of 350° C. to 400° C. Further preferably, the base temperature at the low temperature is 300° C. and the base body temperature at high temperature is 350° C.

On the other hand, the protective later is selected among SiN, SiO, $SiO_2$, SiON, PSG, BSG, BPSG, $ZrO_2$, $Al_2O_3$, SiC, Si and $Ta_2O_5$. It should be noted that the materials of the protective layer formed at low temperature and the protective layer formed at high temperature are not necessarily the same. The protective layer formed at low temperature and the protective layer formed at high temperature are formed as two layer protective layer by switching the base body temperature. The two layer protective layer may be formed with various combinations of the insulative material listed above.

A production method of a liquid ejecting printing head having a base body for the liquid ejecting printing head, according to the present invention including electrothermal transducer element and a driving functional element for driving the electrothermal transducer element, is characterized by forming a P-type semiconductor layer by epitaxial growth on a P-type semiconductor substrate, and subsequently forming the driving functional element utilizing the P-type semiconductor.

A production method of a liquid ejecting printing head, according to the present invention, including a base body preparation process preparing a liquid ejecting printing head, in which an electrothermal transducer element, a driving functional element driving the electrothermal transducer element, a wiring electrode connecting the driving functional element and the electrothermal transducer element, a protective layer provided on the wiring electrode are formed on a substrate, and an ink ejecting portion forming step for forming ejecting portion having ejection opening for ejecting an ink, is characterized in that the production method of a base body for the liquid ejecting printing head includes a deposition step for forming the protective layer by depositing an insulative material on the wiring electrode with elevating a base body temperature in stepwise fashion or sequentially.

When the electrothermal transducer element has a heat generating resistor made of TaN, composition of TaN is to contain 1.9 to 1.0 of Ta relative to N in molecular weight ratio. The heat generating resistor may be made of $HfB_2$, Poly-Si, Ta—Al, Ta—Ir, Au or Ag in place of TaN.

With the production method of the base body according to the present invention, the base body for the ink-jet printing head which is superior in durability, strong against repeatedly applied thermal impact, ink corrosion or cavitation, and can provide high quality printing images for a long period, can be efficiently produced.

Also, in the production method of the printing head according to the present invention, since the protective layer formed at low temperature is inserted, occurrence and growth of buno-shaped projections, called hillocks, during deposition (growth) of the layer by CVD method at high temperature, can be successfully prevented. Therefore, shorting between the wiring electrode or between the wiring and the protective layer of Ta due to unevenness due to hillocks 1101, 1102 as shown in FIG. 2, operation failure to cause lowering of production yield can be avoided. As a result, the printing head can be produced at high yield and thus highly reliable printing head can be provided at low price.

The above and other effects, features and advantages of the present invention will become more apparent from the following descriptions of the embodiments thereof taken in conjunction with the accompanying drawings.

DETAILED DESCRIPTION OF THE PREFERRED EMBODIMENTS

Figure 1:
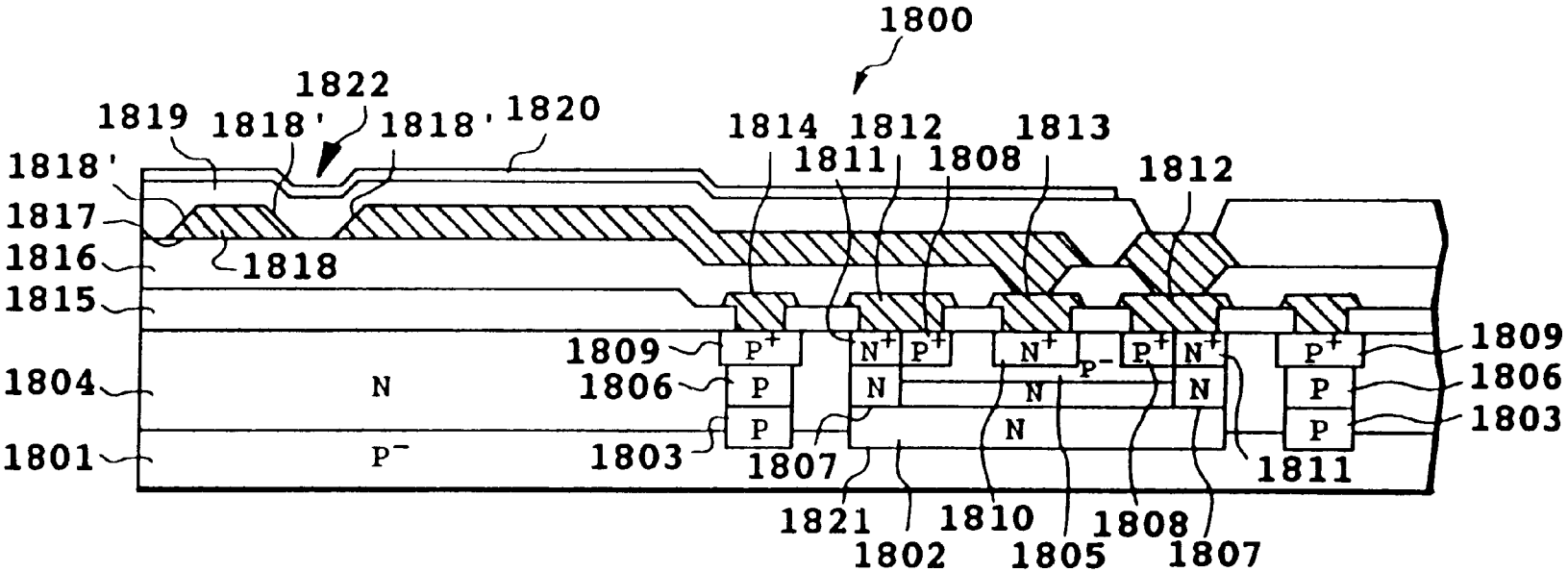
FIG. 1 is a diagrammatic section showing one example of a base body for a printing head according to the present invention.
Figure 2:
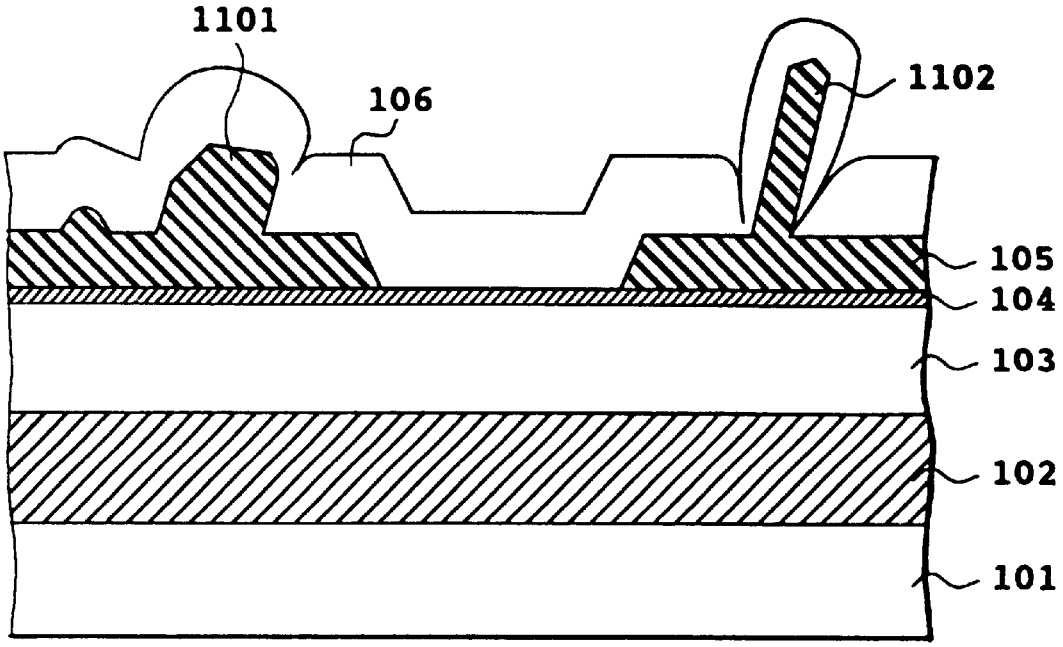
FIG. 2 is a diagrammatic section showing hillock and whisker on Al electrode produced by heating upon deposition of a protective layer.

The followings are experiments performed by the inventors.

Experiment A

Above a heating resistor body provided a heating resistor body shown in FIG. 3 and on an electrode provided below a region at least in the printing head, where ink flows is retained, a protective layer is normally provided. The protective layer serves for chemically and physically protecting a heating resistor body forming these electrode and head acting portion from the ink at the upper side for preventing shorting between the electrodes and leakage between the electrodes of the same kinds, particularly between selection electrodes and for further preventing contact between the ink and the electrode and corrosion of the electrode which can be caused by applying power to the electrode contacting with the ink.

Required properties of the protective layers are different depending upon the position in which they are to be placed. For example, on the heat acting portion, for example, the protective layer is required to have high (I) heat resistance, (II) ink proofing property, (III) ink penetration resistance, (IV) heat conductivity, (V) anti-oxidation property, (VI) insulation ability and (VII) resistance to damage. In the region other than the heat acting portion, thermal condition is reduced, and higher ink penetration resistance, ink proofing property, insulation ability and fracture resistance are required.

However, at the present, there has not been found a material for the protective layer which can satisfy all of the required properties of (I) to (VII) at respective desired level and can cover all of the heat acting portion and the electrode with a single layer. In this circumstance, in the practical printing heads, various materials which may mutually compensate properties required at respective portion to be placed, are selected to form the protective layer consisting of a plurality of layers. For such protective layer of multi-layer structure, it is required to maintain sufficient bonding strength not only between the constituent layers but also with the adjacent layers, and not to cause failure due to lowering bonding force, such as abruption or lift between the layers during production process of the printing head and over a practical use period.

Apart from this, in case of a multi-orifice type ink-jet printing head, a plurality of fine electrothermal transducers are formed simultaneously on the substrate, formation of respective layer and partial removal of the formed layer is repeated on the substrate in the production process. Thus, in the stage for forming the protective layer, the back surface of the portion where the protective layer is formed, fine unevenness with slapwedge portion (stepped portion), step coverage ability of the protective layer at the stepped portion becomes important. When step coverage is poor, penetration of the ink can be caused at this portion to cause stray current corrosion or electric breakdown. On the other hand, when possibility of causing defective portion in the formed protective layer is high in the production method, the ink may penetrate through the defective portion to frequently cause significant shortening of the life of the electrothermal transducer.

For these reasons, the protective layer is further required to have high step coverage, low possibility of occurrence of defective portion, such as pin hole, in the formed protective layer due to the production method thereof. Even if the defect is caused, the defect has to be ignorable or lesser.

Particularly on the heat acting surface, severe temperature variation cycle between high temperature and low temperature is repeated for several thousands of times per one second. Also, the ink on the heat acting surface is evaporated during high temperature period to generate bubble in the ink to elevate the pressure within an ink passage, and associated with lowering of temperature, the evaporated ink is condensed to eliminate the bubble to lower the pressure in the ink passage. Such pressure variation is repeated to constantly apply mechanical stress caused by repeated heat cycle. Therefore, on the protective layer provided for covering at least the upper surface of the heat acting portion, it is particularly required to have high impact resistance against mechanical stress and bonding strength between a plurality of layers consisting protective layer.

Therefore, experiment is performed with respect to breakage strength of the heat generating resistor body upon formation of the layer by varying layer formation temperature of SiN protective layer at the mid-way of layer formation by plasma CVD method.

The heat generating resistor was prepared by forming layer of $TaN_{0.8hex}$ in reactive sputtering method according to the present invention. The layer forming condition is 24% in nitrogen gas pressure, total pressure of argon gas and nitrogen gas at 7.5 mTorr, sputtering power in 2 kW, and the substrate temperature of 200° C. A layer formation apparatus is schematically illustrated in FIG. 4.

Figure 4:
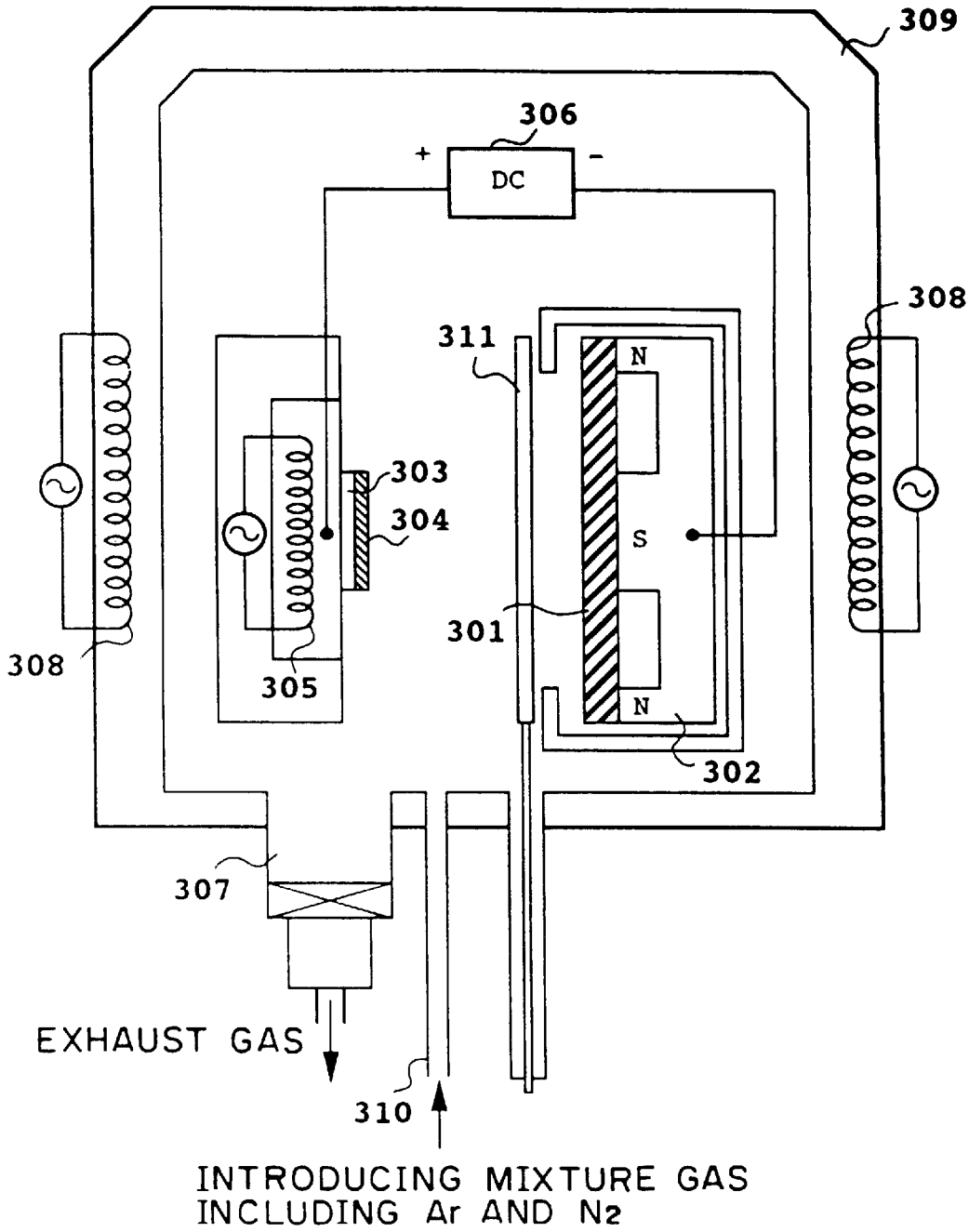
FIG. 4 is a diagrammatic section showing a layer depositing apparatus for forming respective layers of a base body used in the ink-jet printing head according to the invention.

In FIG. 4, the reference numeral 301 denotes a tantalum target. The tantalum target 301 is provided on a flat plate form magnet 302. At a position opposing to the tantalum target 301, a substrate holder 303 holding a substrate 304 is arranged. The substrate 304 is constructed to heat at the predetermined temperature via the substrate holder 303 by a heater 305 mounted on the substrate holder 303. The substrate 304 side and the target 301 side are connected by a DC power source 306. By application of the power source 306, a predetermined potential difference is established between the substrate 304 side and the target 301 side. The target 301, the substrate 304 and the power source 306 are housed within a chamber 309 and arranged therein. The interior space of the chamber 309 is situated in vacuum condition, and a predetermined mixture gas is fed into the chamber 309 from an introduction opening 310. As this mixture gas, a mixture gas of argon (Ar) and nitrogen ($N_2$) can be considered, for example. On the other hand, within the chamber 309, a shutter 311 for opening and closing in front of the target 301 is provided. The shutter 311 can be used effectively for controlling layer thickness of the layer on the substrate 304.

Lower heat accumulation layers 102 and 103 are respectively SiO2 layers formed by way of thermal oxidation or layers, in which Ta layers 107 as cavitation resistant layers are formed above upper SiN protective layer 106. In formation of the protective layer, a plasma CVD apparatus as schematically shown in FIG. 5 was used.

Figure 5:
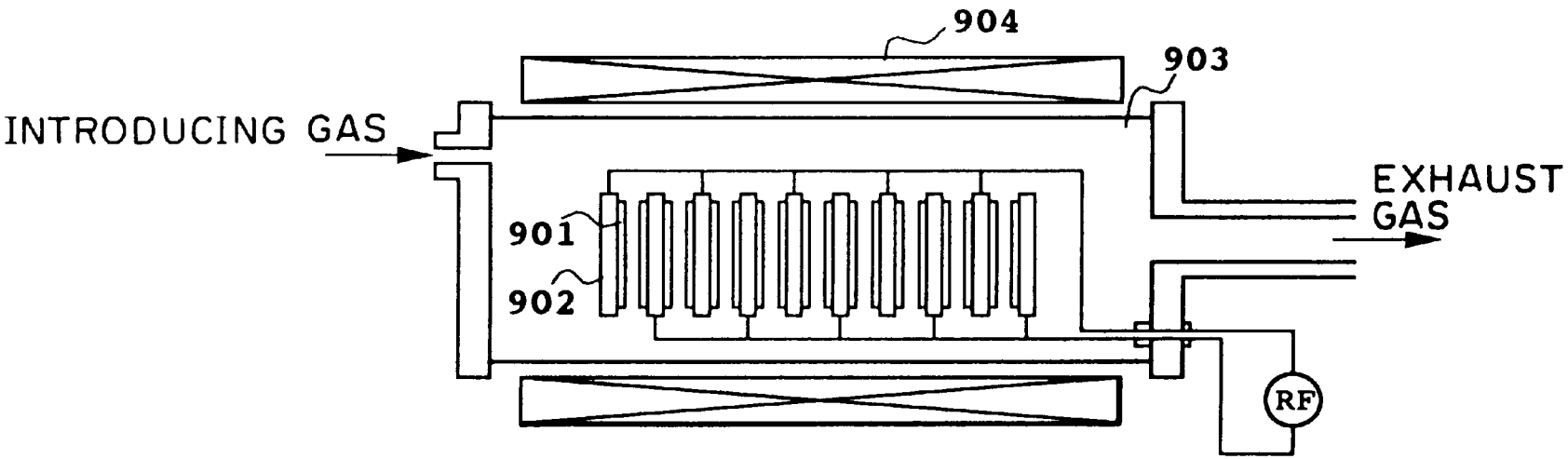
FIG. 5 is a diagrammatic view showing a PE-CVD apparatus for forming a protective layer on a base body.

In FIG. 5, a wafer 901 was mounted on an electrode 902 consisting of carbon. The entire electrode was arranged within a quartz cylinder. A heater 904 is designed for heating the overall quartz cylinder. Thus, the wafer and the electrode within the quartz cylinder was heated to a given temperature. The interior of the quartz cylinder was ventilated by a pump. With introduction of a material gas into the quartz cylinder, an RF voltage of 420 kHz was applied to an opposing carbon electrode tube to generate plasma between the wafer and the electrode tube to deposit the protective layer on the wafer 901 in the thickness of the range greater than or equal to 0.6 $\mu$m and less than or equal to 1.0 $\mu$m.

In this experiment, other layer depositing conditions are set as follows depending upon the layer formation temperature. At the layer formation temperature lower than 300° C., $SiH_2$ gas was 800 SCCM, $NH_3$ gas was 7200 SCCM and pressure was 1.5 Torr. On the other hand, at the layer formation temperature higher than or equal to 300° C., $SiH_4$ gas was 600 SCCM, $NH_3$ gas was 4800 SCCM and pressure was 2.0 Torr.

Figure 6:
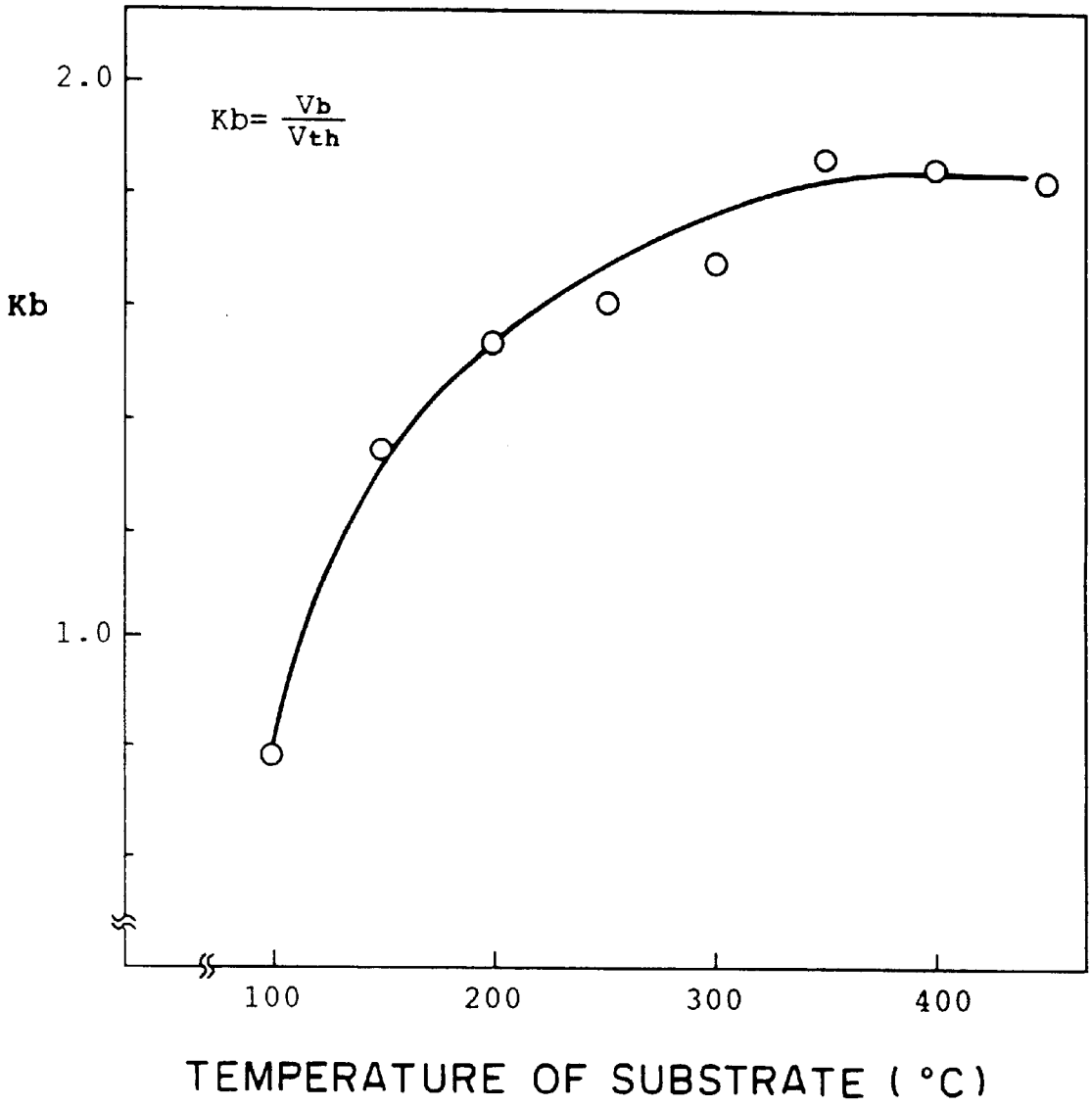
FIG. 6 is a graph illustrating a relationship between a substrate temperature and a breakdown voltage ratio.

FIG. 6 shows a breakdown voltage ratio Kb (Kb=Vb/Vth) of a heat generating body in relation to the layer formation temperature of the protective layer SiN as a result of the experiments set forth above.

An actual drive voltage of the printing head is 1.2 Vth (1.2 times a threshold voltage for bubbling). In view of individual fluctuation, no problem will arise if Kb is greater than or equal to 1.3, and the layer obtained at the layer formation temperature higher than or equal to 150° C. may be used as the printing head. Also, it was found that the layer formation temperature higher than or equal to 200° C. is preferred in order to enhance reliability. Also, at the layer formation temperature higher than or equal to 300° C., highly reliable heat generating body having Kb value greater than or equal to 1.8, could be obtained.

These layer formation temperature dependency is considered that, in the low temperature range, reaction of the material gas becomes insufficient to remain a large amount of non-reacted Si—H, N—H and so forth in the layer to make the density of the layer low, and to make coupling force of the layer forming molecule insufficient.

At the layer formation temperature higher than or equal to 350° C., $TaN_{0.8hex}$ layer was covered with dense and solid SiN layer for restricting change of property of the $TaN_{0.8hex}$ layer. Thus, the ink-jet printing head with high reliability could be obtained.

Experiment B

Figure 3:
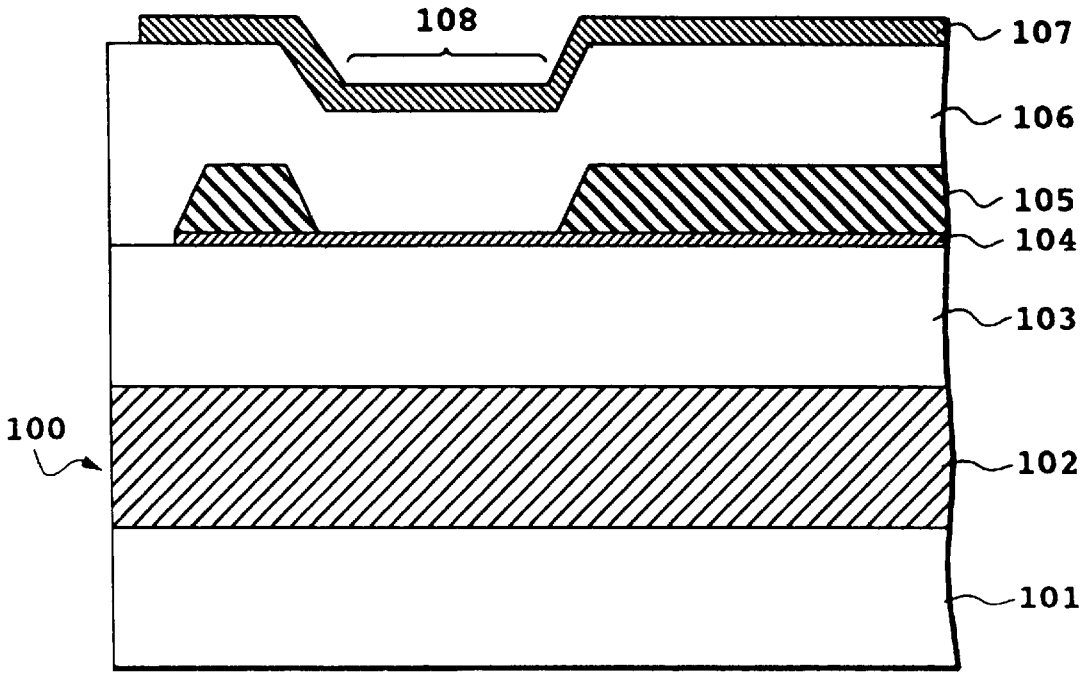
FIG. 3 is a diagrammatic section showing a base body for an ink-jet printing head.

Next, study was made for influence for wiring portion on the base layer during formation of the protective layer 106 in the layer structure shown in FIG. 3.

In the conventional layer structure shown in FIG. 3, after formation of wiring 105 of Al or Al alloy, the protective layer 108 having a thickness in the range greater than or equal to 0.6 $\mu$m and less than or equal to 1.0 $\mu$m. As the protective layer and the interlayer insulation layer, PSG, BPSG, SiO, $SiO_2$ SiON and SiN layers are formed at a temperature in a range of higher than or equal to 300° C. and lower than or equal to 450° C., by way of normal pressure CVD, plasma CVD or so forth.

In the conventional technology, a bulge in the order of greater than or equal to 1 $\mu$m and less than or equal to 2 $\mu$m, which is called as hillock 1101 by heating during formation of the protective layer, as is well known. Also, projection reaching several $\mu$m or more, called as whisker 1102 is also caused. If hillock 1101 and/or whisker 1102 are caused, failure of coverage is caused in the protective layer. Furthermore, the cavitation resistant layer Ta formed above and Al wiring may cause electrical shorting to result in operation failure. Size and density of the hillock 1101 and the whisker 1102 significantly affect for reliability and yield in production of the ink-jet printing apparatus. In this experiment, with respect to the SiN protective layer in the former experiment set forth above, study was made for a relationship between the layer formation temperature and Al hillock, Al whisker and layer quality of the protective layer. The result is shown in the following Table 1.

In the Table 1, respective value of 100° C. to 450° C. in the column of the layer formation temperature represent that the layer is deposited at constant temperature and a given period. In the column of the hillock and whisker restriction, a mark "x" represents substantial growth of the hillock or whisker being observed, a mark "Δ" represents slight growth of the hillock or whisker being observed and a mark "O" represents little growth of hillock or whisker being observed. On the other hand, in the column of the layer quality, x represents particularly low density, Δ represents slightly low density and O represents high density.

TABLE 1

| SAMPLE NO. | LAYER FORMATION TEMP. (° C.) | RESTRICTION OF HILLOCK OR WHISKER | LAYER QUALITY |
|---|---|---|---|
| 1 | 100 | ○ | X |
| 2 | 150 | ○ | Δ |
| 3 | 200 | ○ | Δ |
| 4 | 250 | ○ | Δ |
| 5 | 300 | ○ | Δ |
| 6 | 350 | Δ | ○ |
| 7 | 400 | X | ○ |
| 8 | 450 | X | ○ |

From the foregoing Table 1, it has been found that when layer deposition is performed at higher than or equal to 100° C. to lower than or equal to 300° C., the hillock or whisker does not grow significantly. However, the layer deposited and formed at low temperature is relative "loose" in the layer quality to cause lowering of the Kb value and degradation of reliability of the base body and the printing head employing it. On the other hand, at the temperature lower than or equal to 150° C., difficulty should arise for controlling temperature in view of the construction of the CVD apparatus. Accordingly, the preferred layer formation temperature to obtain the SiN protective layer having relatively high density in the layer quality with restricting growth of hillock and whisker in the Al wiring is found in a range of higher than or equal to 200° C. to lower than or equal to 300° C.

Experiment C

Next, layer deposition is performed by separating into two stages and varying layer formation temperature in deposition of the layer.

The first stage of layer deposition was performed at the layer formation temperature of 200° C., 250° C. and 300° C., at which effect of restriction of occurrence of hillock and whisker was found from the result of Table 1. The layer formation apparatus and layer forming condition other than layer formation temperature is the same as Experiment B. Evaluation was performed in the similar manner to the above. The results of Experiment C is shown in the following Table 2.

In the following Table 2, the indication of layer formation temperature 200–350 represents that layer deposition in a layer thickness of approximately 1500 Å was performed at 200° C., and thereafter layer deposition in a layer thickness greater than or equal to 4500 Å and less than or equal to 8500 Å was performed at 350° C.

Figure 7:
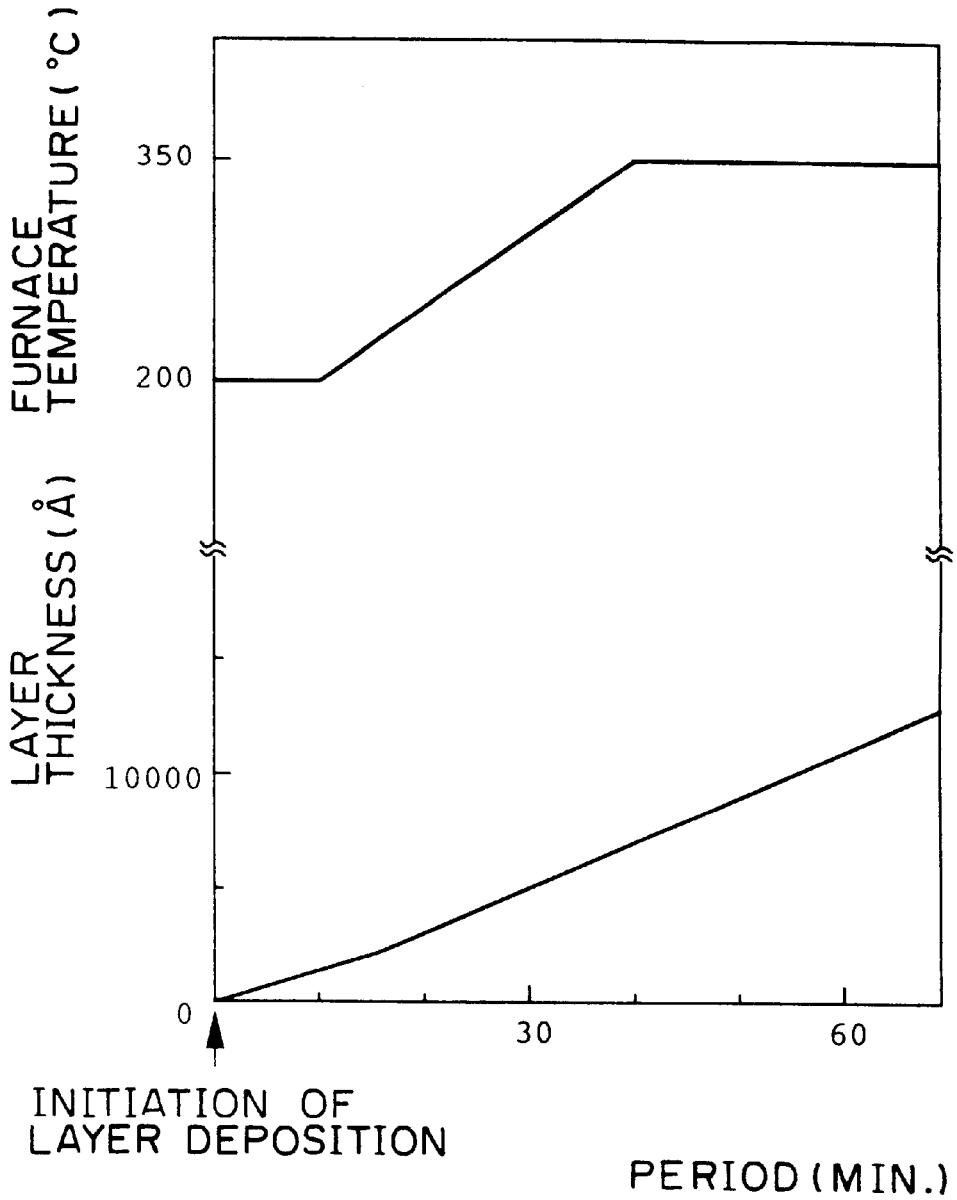
FIG. 7 is a graph illustrating a relationship between an elapsed period from initiation of layer deposition in two stage layer deposition, layer thickness and a furnace temperature.

It should be noted that FIG. 7 is a graph illustrating a relationship between an elapsed time from initiation of layer deposition in two steps layer formation, and a layer thickness and a furnace temperature. In the example of FIG. 7, the initial growth temperature was set at 200° C. upon initiation of layer deposition, the deposition temperature was risen gradually, the temperature at the later stage of the growth of layer deposition was set at 350° C. and then the deposition temperature was maintained at constant to continue deposition. At this time, while the layer thickness is increased at substantially the constant rate from initiation of deposition, the protective layer at the initial stage of deposition has lower density in comparison with the protective layer formed at the later stage of deposition where the layer formation temperature is higher than that in the initial stage. The density is increased according to elevating of the deposition temperature.

TABLE 2

| SAMPLE NO. | LAYER FORMATION TEMP. (° C.) | RESTRICTION OF HILLOCK OR WHISKER |
|---|---|---|
| 1 | 200–350 | ○ |
| 2 | 200–400 | Δ |
| 3 | 200–450 | X |
| 4 | 200–350 | ○ |
| 5 | 250–400 | Δ |
| 6 | 250–450 | X |
| 7 | 300–350 | ○ |
| 8 | 300–400 | Δ |
| 9 | 300–450 | X |

In the two steps layer deposition set forth above, remarkable restriction of occurrence of hillock and/or whisker could be achieved in the layer formation temperature of higher than or equal to 200° C. to lower than or equal to 300° C. in the first stage and in the layer formation temperature of higher than or equal to 350° C. to lower than or equal to 400° C. in the first stage. The layer quality was high density and solid. Thus, highly reliable protective layer can be obtained.

This is because that upon layer formation of the high density layer at higher layer formation temperature at the second stage, the layer of the first stage formed at lower layer formation temperature than that in the second stage may depress the Al wiring against local stress caused in the Al wiring. Thus, with the process as set forth above, growth of the hillock and/or whisker can be successfully restricted.

In the shown experiments, a hot wall type plasma CVD apparatus in which overall reaction chamber can be heated, was employed for multi-number batch type and whereby superior in applicability for mass-production. However, a batch process type having parallel flat electrodes or cold wall type individual piece processing type, in which a substrate support (suscepter) mounting the substrate is heated, may also be employed.

The protective layer is not limited to SiN layer but can be $SiO_2$ layer, SioN layer, SiO layer, SiC layer, Si layer, PSG layer, PSG layer, BPSG layer, $ZrO_2$ layer, $AL_2O_3$ layer, $Ta_2O_5$ layer or layer formed by way of normal pressure CVD method or sputtering method. Also, it is further possible to be two stage layer deposition with the combination of the above.

The base body for the ink-jet printing head in the shown embodiment is preferred to be formed by performing process at step of forming the layer at relatively low substrate temperature and a step of forming the layer at relatively high substrate temperature.

At this time, it is preferred that the substrate temperature in the former step is set in the range of 200° C. to 300° C., and the substrate temperature in the later step is set in the range of 350° C. to 400° C. The base body for the ink-jet printing head thus obtained can restrict hillock phenomenon to be caused in the electrode layer set forth above. The ink-jet printing head employing such base body has quite excellent ink-jet head printing head characteristics.

The embodiments of the base body for the ink-jet printing head according to the present invention will be discussed hereinafter.

The base body 100 for the ink-jet printing head generally has head accumulating layers 102 and 103 on the substrate 101. These heat accumulation layers are provided for efficiently transmitting the energy caused by application of voltage to the heat generating body. The heat accumulation layer is constructed with a material having low heat conductivity. The heat accumulation layer 103 also serves as an insulation layer.

Above the heat accumulation layer 103, a resistor layer 104 forming the heat generating body set forth above, the wiring layer 105 formed of a material having high electric conductivity is stacked. The portion where the wiring layer 105 is not provided, serves as the heat generating resistor.

In the construction set forth above, when an electrical signal is applied to the heat generating resistor via the wiring 105, the heat generating resistor generates a heat. Also, in the base body for the ink-jet printing head, the protective layer 106 can be provided for the purpose of covering of the wiring 105 and/or the heat generating body. This protective layer 106 contributes for preventing the heat generating resistor or the wiring 105 from contacting with the ink or stray current corrosion or electrical insulation breakdown due to penetration of the ink. On the protective layer, a cavitation resistant layer 107 is typically provided. The cavitation resistant layer is provided for the purpose of protection of the protective layer 106 and the heat generating resistor from cavitation caused by collapsing of bubble after ink ejection by heating of the heat generating resistor, i.e. upon ejection of the ink.

Concerning heat generating resistor and the base body for the ink-jet printing head having layer construction, discussion will be given for formation of a bipolar type NPN transistor 1821 as driving function element in the base body on a P-type silicon substrate 1801.

Hereinafter, discussion will be given for the present invention with reference to the drawings. However, the present invention should not be limited to the shown embodiments and can be any one which can achieve the task of the present invention.

FIG. 1 is a diagrammatic section of one embodiment of a base body for the printing head to be produced according to the present invention.

The base body 1800 as the base body for the printing head is formed with a heat acting portion 1810 as electrothermal transducer element and bipolar type NPN transistor 1821 as driving function element on the P-type silicon substrate 1801.

In FIG. 1, 1801 denotes the P-type silicon substrate, 1802 denotes an N-type collector buried region forming a functional element, 1803 denotes a P-type isolation buried region for functional element isolation, 1804 denotes an N-type epitaxial region, 1805 denotes a P-type base region, 1806 denotes a P-type isolation buried region for element isolation, 1807 denotes an N-type collector buried region for forming the functional element, 1808 denotes a high concentration P-type base region for forming the element, 1809 denotes a high concentration P-type isolation region for element isolation, 1810 denotes an N-type emitter for forming element, 1811 denotes a high concentration N-type collector for forming the element, 1812 denotes a collector and base common electrode, 1813 denotes an emitter electrode, and 1814 denotes an isolation electrode. Here, NPN transistor is formed. The collector regions 1802, 1804, 1807 and 1811 completely surround emitter region 1810 and the base regions 1805 and 1808. On the other hand, as the element isolation region, respective cells are surrounded by P-type isolation buried region 1806, P-type isolation region 1807 and high concentration P-type isolation region 1809 for electrical isolation.

Here, NPN transistor 1821 has an NPN transistor structure with two high concentration N-type collector region 1811 formed on the P-type silicon substrate 1801 via an N-type collector buried region 1802 and N-type collector buried region 1802, two high concentration P-type base region 1808 formed inside of the high concentration N-type collector region 1811 via the N-type collector buried region 1802 and the P-type base region 1805, and a high concentration N-type emitter region 1810 formed between the high concentration P-type base region 1808 via the N-type collector buried region 1802 and the P-type base region 1805. Then, the NPN transistor 1821 acts as a diode by connecting the high concentration N-type collector region 1811 and the high concentration base region 1808 via the collector and base common electrode 1812. Also, adjacent the NPN transistor 1821, the P-type isolation buried region 1803, the P-type isolation region 1806 and high concentration P-type isolation region 1804 as element isolation regions are formed in order. On the other hand, the resistor layer 1817 is formed on the P-type silicon substrate 1801 via the N-type epitaxial region 1804, the heat accumulation layer 1815 and the interlayer insulation layer 1816 which also serves as the heat accumulation layer integrally provided with the head accumulation layer 1815. By respectively forming two edges 1818' as connecting end faces by cutting the wiring electrode 1818 formed on the resistor layer 1817, heat acting portion 1822 is constructed.

The entire surface of the base body 1800 for the printing head is covered with the heat accumulation layer 1815 formed with thermal oxidation layer or so forth. From functional elements, respective electrodes 1812, 1813, 1814 are formed with Al so forth. It should be noted that respective electrodes 1812, 1813 and 1814 have side surfaces (end portions) inclined at an angle θ (greater than or equal to 30° and less than or equal to 75°) relative to the normal are shown in enlarged manner in FIGS. 8 and 9 (electrode 1814, emitter, collector and base and so forth are neglected).

The base body 1800 is constructed by covering the P-type silicon substrate 1801 for the printing head having driving portion (functional element) set forth above with the heat accumulation layer 1815 including the collector and base common electrode 1812, the emitter electrode and the isolation electrode 1814. In the upper layer, the interlayer insulation layer 1816 of silicon compound, such as SiO, SiO2, SiN, SiON and so forth is formed by normal pressure CVD method, plasma CVD method, sputtering method and so forth. Since Al or so forth forming respective electrodes 1812, 1813, 1814 have inclined end surfaces, step coverage of the interlayer insulation layer is superior to permit to form the interlayer insulation layer 1816 thinner in comparison with the conventional one without degrading heat accumulation effect. By partially opening the interlayer insulation layer 1816, the collector and base common electrode 1812, the emitter electrode 1813 and the isolation electrode 1814 are electrically connected, and on the interlayer insulation layer 1816, the wiring electrode 1818 of Al or so forth for forming the electorial wiring is provided namely, after partially opening the interlayer insulation layer, the electrothermal transducer element constructed with the resistor layer 1817 constructed with fine polycrystal of $TaN_{0.8hex}$ by reactive sputtering and the wiring electrode 1818 of Al or so forth formed by deposition method or sputtering method, is provided.

Figure 10:
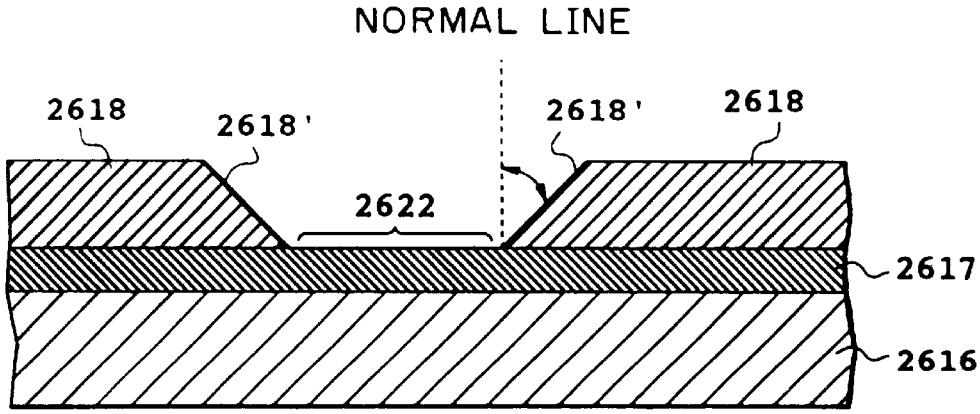
FIG. 10 is a diagrammatic section of the wiring electrode and the heat acting portion.
Figure 11:
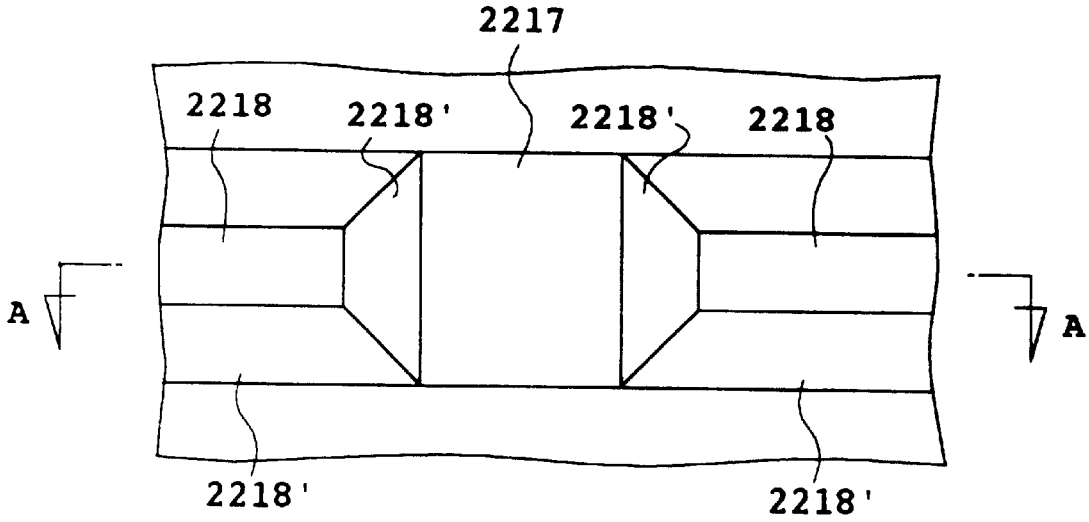
FIG. 11 is a diagrammatic front elevation showing a configuration of the wiring electrode.
Figure 12:
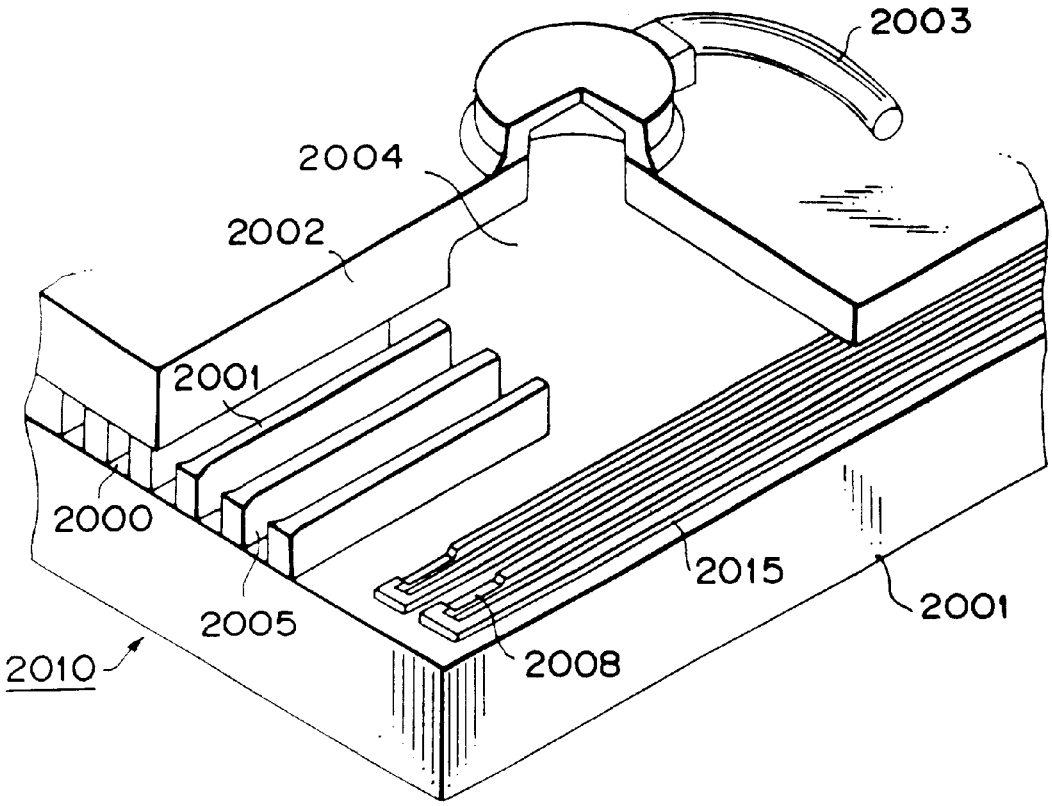
FIG. 12 is a diagrammatic perspective view showing inside of an ink-jet printing head.

FIG. 10 is an enlarged section of the electrothermal transducer, and FIG. 11 is an enlarged plan view of the electrothermal transducer.

The wiring electrode 1818 of Al or so forth has edge portion (and side surface portion) 1818' as connecting end face inclined greater than or equal to 3OK relative to the normal. Furthermore, on the heat acting portion 1822 of the electrothermal transducer element shown in FIG. 1, the protective layer 1820 of SiO, $SiO_2$, SiN, SiON, SiC, Si, PSG, BSG, BPSG, $ZrO_2$ $Al_2O_3$, $Ta_2O_5$ and the protective layer 1816 of Ta and so forth are provided integrally with the interlayer insulation layer 1819.

Figure 8:
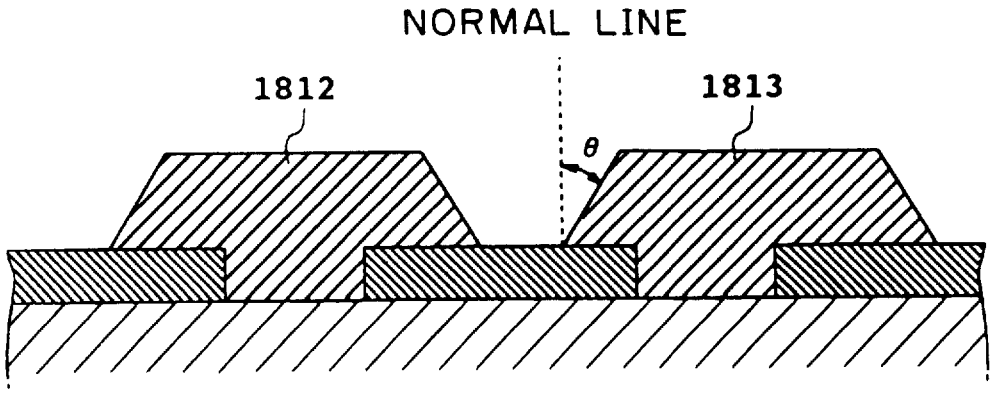
FIG. 8 is a diagrammatic section showing a configuration of a wiring electrode.
Figure 9:
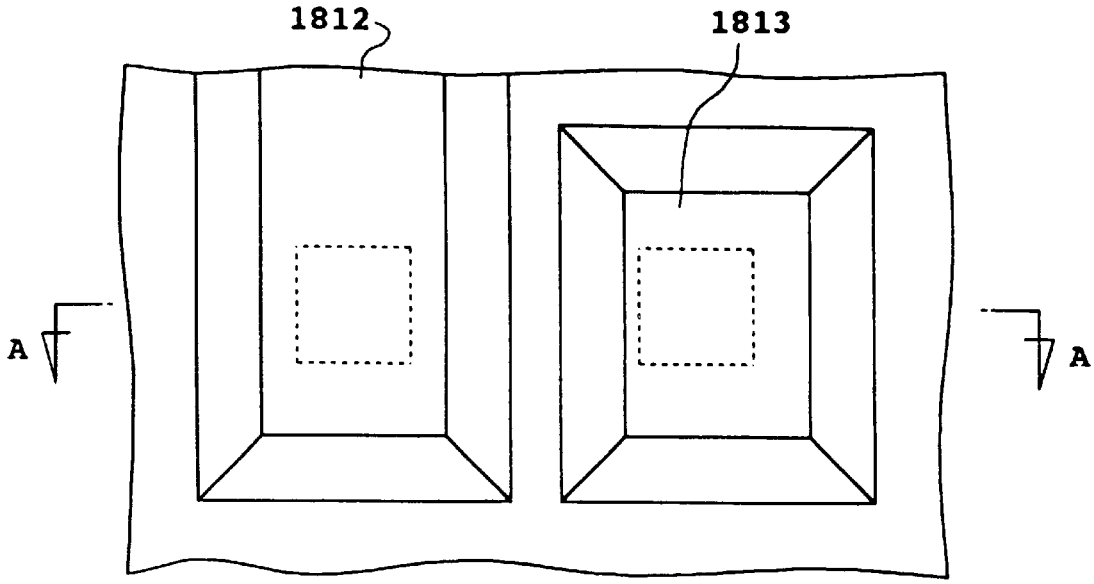
FIG. 9 is a diagrammatic front elevation showing a configuration of the wiring electrode.

Furthermore, the base body 1800 is formed into a linear tapered shaped configuration of edge portion(or side portion) 1818' (see FIG. 1) of the wiring electrode 1818. The configurations of the edge portion and both sides of the collector and base common electrode 1812, the emitter electrode 1813 and the isolation electrode 1814 are also in linear tapered configuration as shown in FIGS. 8 and 13, respectively.

On the other hand, since quite high step coverage can be obtained in the first protective layer 1819, the thickness of the first protective later 1819 can be made thinner (e.g., greater than or equal to 0.6 $\mu$m and less than or equal to 1.0 $\mu$m) than that in the configuration where the edge portion 1818' is right angle. As a result, the thermal energy generated at the heat acting portion 1822 can be effectively and quickly transmitted to the ink. In conjunction therewith, throughput of the apparatus for forming the first protective layer can be improved to be about double in comparison with the prior art. Furthermore, upon forming the interlayer insulation layer 1816, the protective layer 1819 and so forth with SiO, SiON, SiN, $SiO_2$, SiC, Si, PSG, BSG, BPSG, $ZrO_2$, $Al_2O_3$, $TaO_5$ and so forth by way of plasma CVD method and sputtering method, the deposition method that the lower layer of the layer is deposited at low temperature in the range higher than or equal to 200° C. and lower than or equal to 300° C., and subsequently the upper layer of the layer is deposited at a temperature range higher than or equal to 350° C. and lower than or equal to 400° C. Namely, growth of the hillock and/or whisker which can be grown during layer deposition at high temperature, can be effectively restricted by the layer formed at low temperature. In comparison with the case where the layer is deposited at one depositing operation at the constant temperature without varying the layer forming temperature in several steps during layer formation within the temperature range higher than or equal to 250° C. and lower than or equal to 450° C., shorting due to growth of hillock or whisker can be reduced to significantly improve yield in production. It should be noted that in the following discussion, for the electrodes other than wiring electrodes, the edge portion (connecting end surface) will also be referred to as side surface.

Next, discussion will be given for basic operation of the functional element (drive portion) constructed as set forth above.

Figure 13:
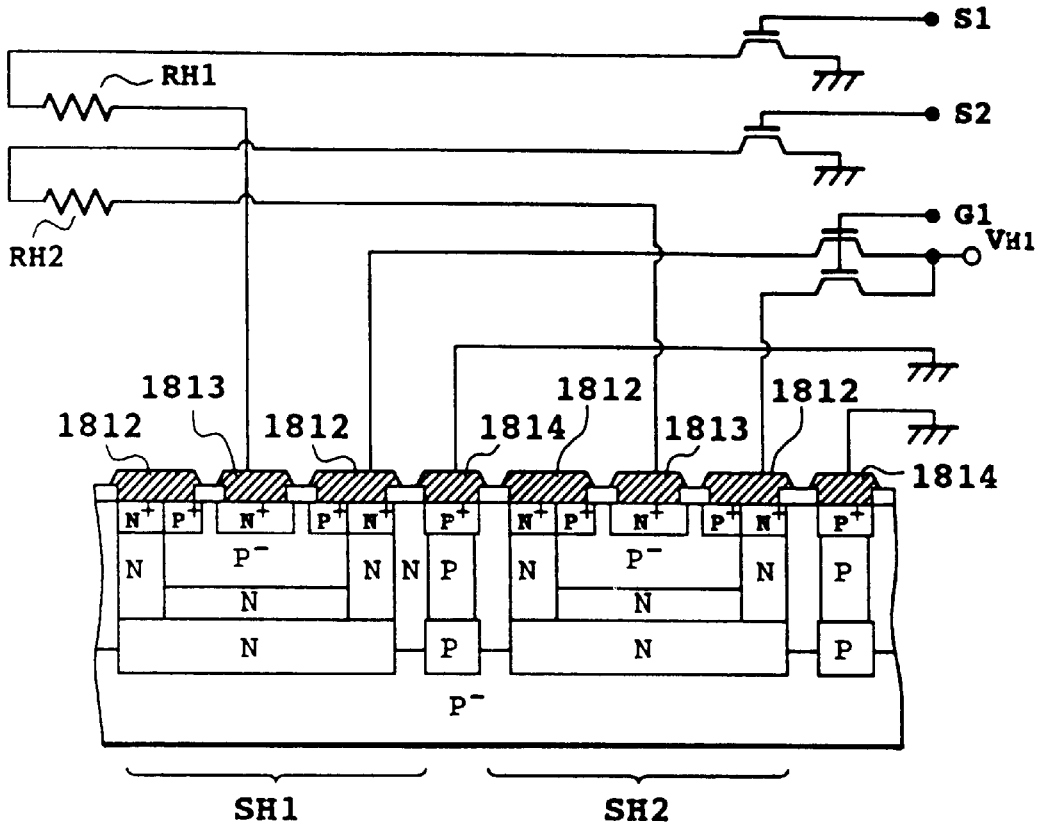
FIG. 13 is a diagrammatic illustration explaining driving method of a base body for an ink-jet printing head.

FIG. 13 is a diagrammatic illustration for explaining the driving method of the base body 1800 shown in FIG. 1.

Here, as shown in FIGS. 1 and 13, the collector and base common electrode 1812 correspond to an anode electrode of the diode, the emitter electrode 1813 corresponds to a cathode electrode of the diode. Namely, by applying the positive potential bias (VH1) on the collector and base common electrode 1812, the NPN transistor in a cell (SH1, SH2) is turned ON so that the bias current flows through the emitter electrode 1813 as the collector current and the base current. On the other hand, as a result of construction shorting the base and collector, rising and falling characteristics of the electrothermal transducer element (RH1, RH2) becomes better to improve controllability of causing of film boiling and growth and shrinking of bubble associated therewith to permit stable ink ejection. The reason is considered that, in the ink-jet printing head utilizing the thermal energy, the transistor characteristics and the film boiling characteristics are closely associated, and small amount of accumulation of minority carrier in the transistor contribute for quick switching characteristics for improving rising characteristics provides unexpectedly significant effect. On the other hand, parasitic effect is relatively small to eliminate fluctuation between the elements so that stable drive current can be obtained.

Here, by grounding the isolation electrode 1814, flowing of the charge into the cell can be prevented to avoid a problem of malfunction of other elements.

In such semiconductor device, it is desired that the concentration of the N-type collector buried region is set to be greater than or equal to $1\times10^{18}$ $cm^{-3}$, the concentration of the P-type base region is set to be greater than or equal to $5\times10^{14}$ $cm^{-3}$ and smaller than or equal to $5\times10^{17}$ $cm^{-3}$, the area of the junction between the high concentration base region 1808 and the electrode is set to be as small as possible. Thus, a leak current flowing from the NPN transistor via the P-type silicon substrate 1801 and the isolation region can be prevented.

Further detailed discussion will be given for the driving method of the base body set forth above, While only two semiconductor functional elements (cells) are shown in FIG. 13, such functional elements are arranged corresponding to 128 in number of electrothermal transducer elements, for example, in a given interval, in practical construction an electrical matrix connection is established for permitting block driving. Here, for simplification of disclosure, discussion will be given for driving the electrothermal transducer elements RH1 and RH2 as two segments in the same group. In order to drive the electrothermal transducer element RH1, the group is selected by a switching signal G1. In conjunction therewith, the electrothermal transducer element RH1 is selected by the switching signal S1. Then, the diode cell SH1 in the transistor construction is supplied a positively biased current to cause heating in the electrothermal transducer element RH1. The thermal energy causes variation of the state in the ink to generate bubble for ejecting ink through ejection opening.

Similarly, when the electrothermal transducer element RH2 is to be driven, the electrothermal transducer element RH2 is selected by the switching signal G1 and the switching signal S2 to drive the diode cell SH2 to supply a current to the electrothermal transducer element.

At this time, the P-type silicon substrate 1801 is grounded via the isolation regions 1803 and 1809. Thus, by arranging the isolation regions 1803, 1806 and 1809 in each semiconductor element (cell), malfunction due to electrical interference between respective semiconductor elements can be successfully eliminated.

Figure 14:
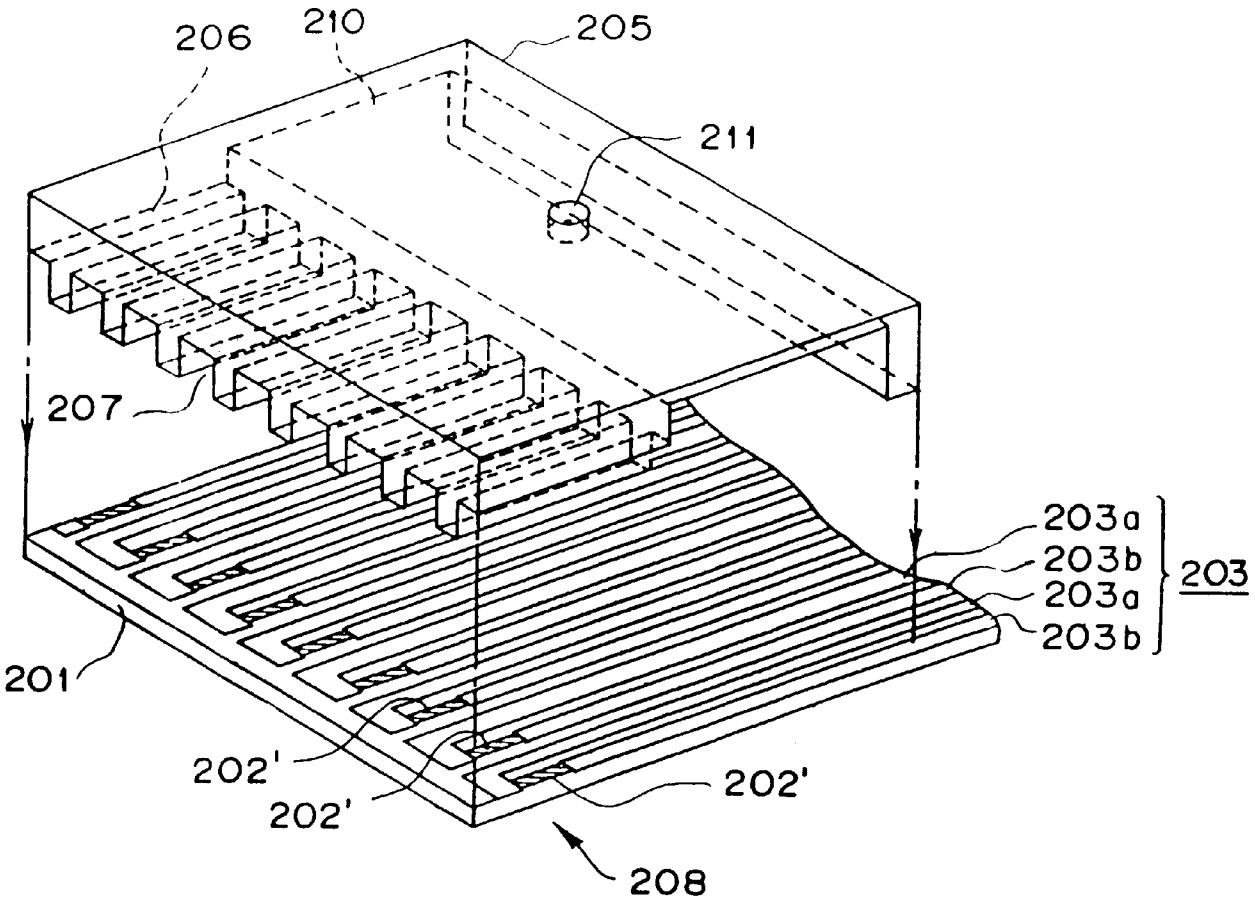
FIG. 14 is a diagrammatic perspective view showing the ink-jet printing head.
Figure 15:
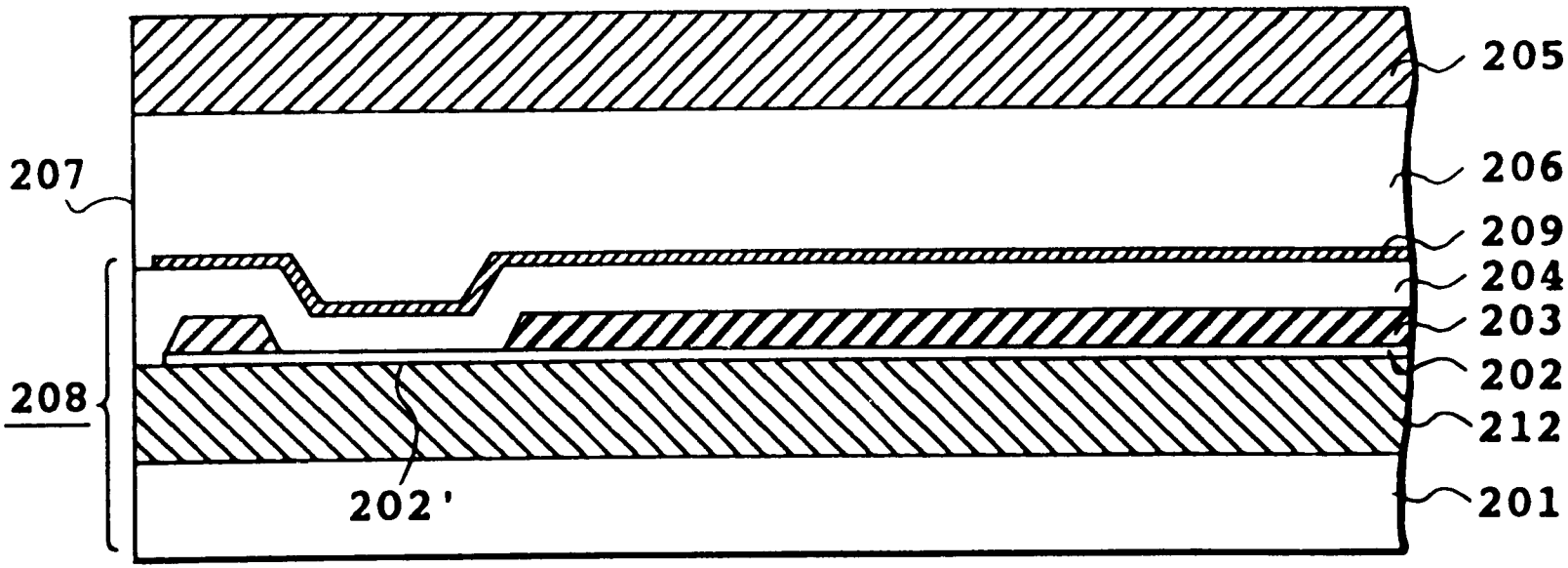
FIG. 15 is a diagrammatic section showing the ink-jet printing head.

The base body 1800 thus constructed is assembled with an ink passage wall member of photosensitive resin for forming the ink passage 206 communicated with a plurality of ejection openings 207, an upper plate 205 having the ink supply opening 211 to form the ink-jet printing type printing head 208, as shown in FIGS. 14 and 15.

In this case, the ink supplied from the ink supply opening 211 is accumulated in a common liquid chamber 210 therein and supplied to respective ink passages 206. At this condition, by driving the heat acting portion of the base body 1800, the ink is ejected through the ink ejecting openings 207.

Next, an example, in which a drive element of a logic circuit or so forth, for example, in place of the diode array, is provided on the common substrate to the printing head, will be discussed.

For higher density, higher printed image quality and higher printing speed of the printing apparatus, it is inherently required to increase the number of the ejection openings. An example for eliminating increasing of the wiring connection between the printing head and the printing apparatus and eliminating electrical energy loss to permit efficient driving will be discussed hereinafter.

On the substrate which is the same substrate on which the heat generating resistor is formed, a shift transistor having MOS transistor construction and adapted to perform drive signal processing and a power transistor of high voltage bipolar transistor for heating the heat generating element are included.

These drive elements are formed on the S1 substrate in semiconductor technology generally called as Bi-CMOS technology. On the same substrate as the Si substrate, the heat acting portion is formed.

Figure 16:
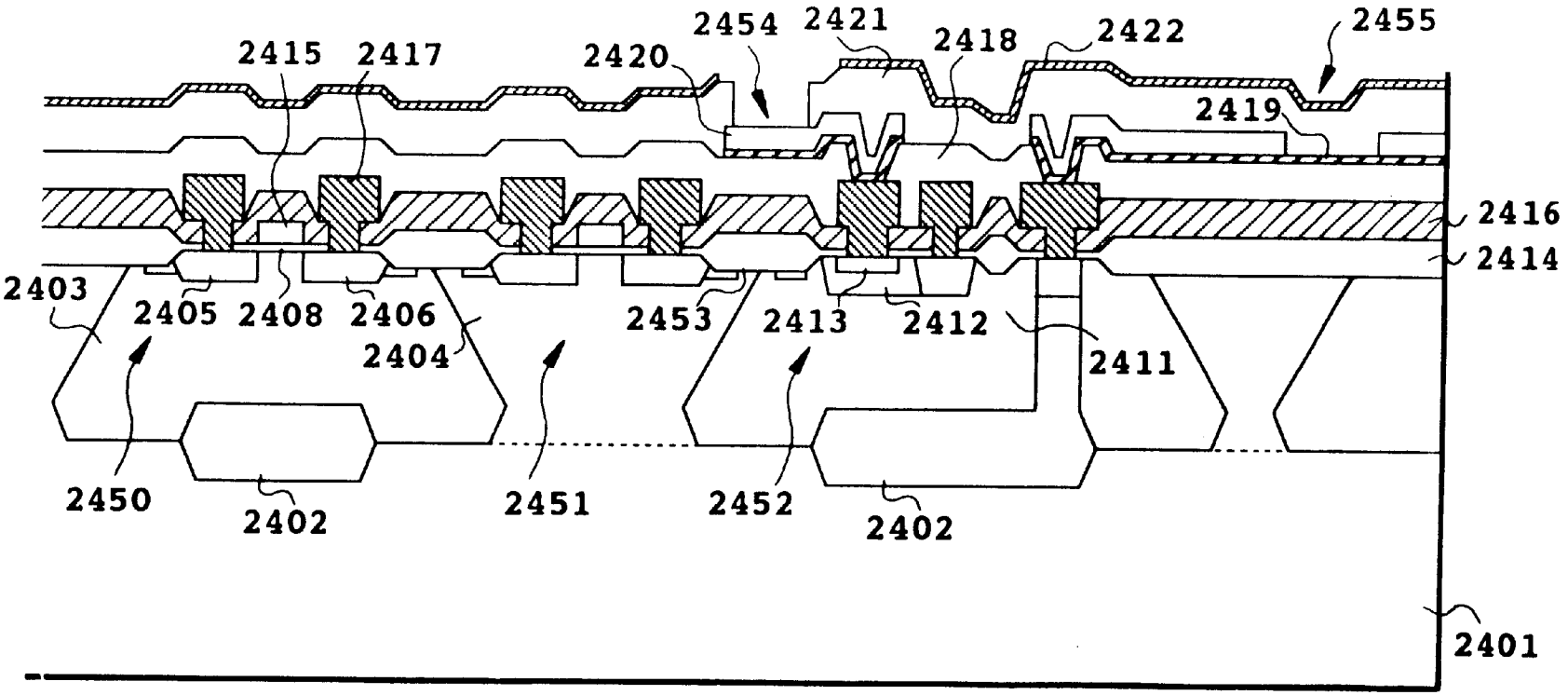
FIG. 16 is a diagrammatic section longitudinally cutting a major element of a base body for an ink-jet printing head according to the invention.

FIG. 16 is a diagrammatic section cut to longitudinally cut the major elements.

To Si substrate 240 as P-type conductor, dopant, such as As or so forth is implanted by ion implantation and diffusion means to form N-type buried layer 2402. Then, an N-type epitaxial layer 2403 is formed in a thickness greater than or equal to 5 $\mu$m and less than or equal to 10 $\mu$m thereover.

On the other hand, by introducing impurity, such as B or so forth in the epitaxial layer 2403, P-type well region 2404 is formed. Subsequently, by photolithography, oxidation diffusion and ion implantation and so forth, doping of impurity is repeated to form P-MOS 2450 in the N-type epitaxial region and N-MOS 2451 is formed in the P-type well region. The P-MOS 2450 and N-MOS 2451 are formed with gate wiring 2415 if polycrystalline silicon deposited in a thickness greater than or equal to 4000 Å and less than or equal to 5000 Å via a gate insulation layer 2415 of several hundreds A of thickness, source region 2405 and drain region 2406 formed by doping N-type or P-type impurity.

On the other hand, the NPN type transistor 2453 to be the power transistor is formed by forming a collector region 2411, a base region 2412 and an emitter region 2413 within the N-type epitaxial layer through impurity doping, diffusion process and so forth.

Also, between respective elements, isolative oxide layer 2453 formed by field oxidation in the thickness greater than or equal to 5000 Å and less than or equal to 10000 Å are formed. The field oxide layer serves as a first heat accumulation layer 2414 below the heat acting portion 2455.

After formation of respective elements, an interlayer insulation layer 2416 of PSG, BPSG or so forth is deposited by CVD method in a thickness about 7000 Å. Then, by heat treatment of flattening process, wiring with a first layer Al electrode 2417 is performed through contact holes.

Thereafter, the interlayer insulation layer 2418 of SiO or so forth is deposited in the thickness greater than or equal to 5000 Å and less than or equal to 10000 Å by way of plasma CVD method. Then, through contact holes, $TaN_{0.8hex}$ layer according to the present invention is deposited in the thickness of about 1000 Å as the resistor later 2419 by way of sputtering method.

Next, as set out with respect to experiments B and C, a protective layer 2421 of SiN layer is formed by two stage layer deposition into about 10000 Å of thickness by initially deposing at a temperature higher than or equal to 200° C. and lower than or equal to 300° C., and subsequently at a temperature higher than or equal to 350° C. and lower than or equal to 400° C.

In the upper most layer, a cavitation resistant layer 2422 of Ta or so forth is deposited in the thickness about 2000 Å with opening a pad portion 2454.

Finally, annealing process is performed under H2 atmosphere at about 400° C. to complete the base body of the printing head.

In the final annealing process, improvement of contacting ability between Al and Si substrate and recovery of damage caused in the elements by various heat treatment and plasma process or so forth.

After completion of the base body of the printing head, the ink ejection openings for ejection of ink and so forth are formed in the similar manner to the former embodiment and thus formed into the ink-jet printing head.

Here, while the power transistor is constructed with the bipolar transistor, it can be formed with MOS transistor.

As a liquid (ink) for printing applicable for the ink-jet printing head according to the present invention, various liquids or inks can be selected.

Generally, it is preferred to have an ink composition containing 0.5 wt % to 20 wt % of dye, 10 wt % to 90 wt % of (polyhydric) alcohol, water soluble organic solvent, such as polyalkyl glycol and so forth. As one example, the preferred ink composition contains 3 wt % of C.I. food black 2, 25 wt % of dimethyl glycol, 20 wt % of N-methyl-2-pyrrolidone and 52 wt % of water.

Figure 17:
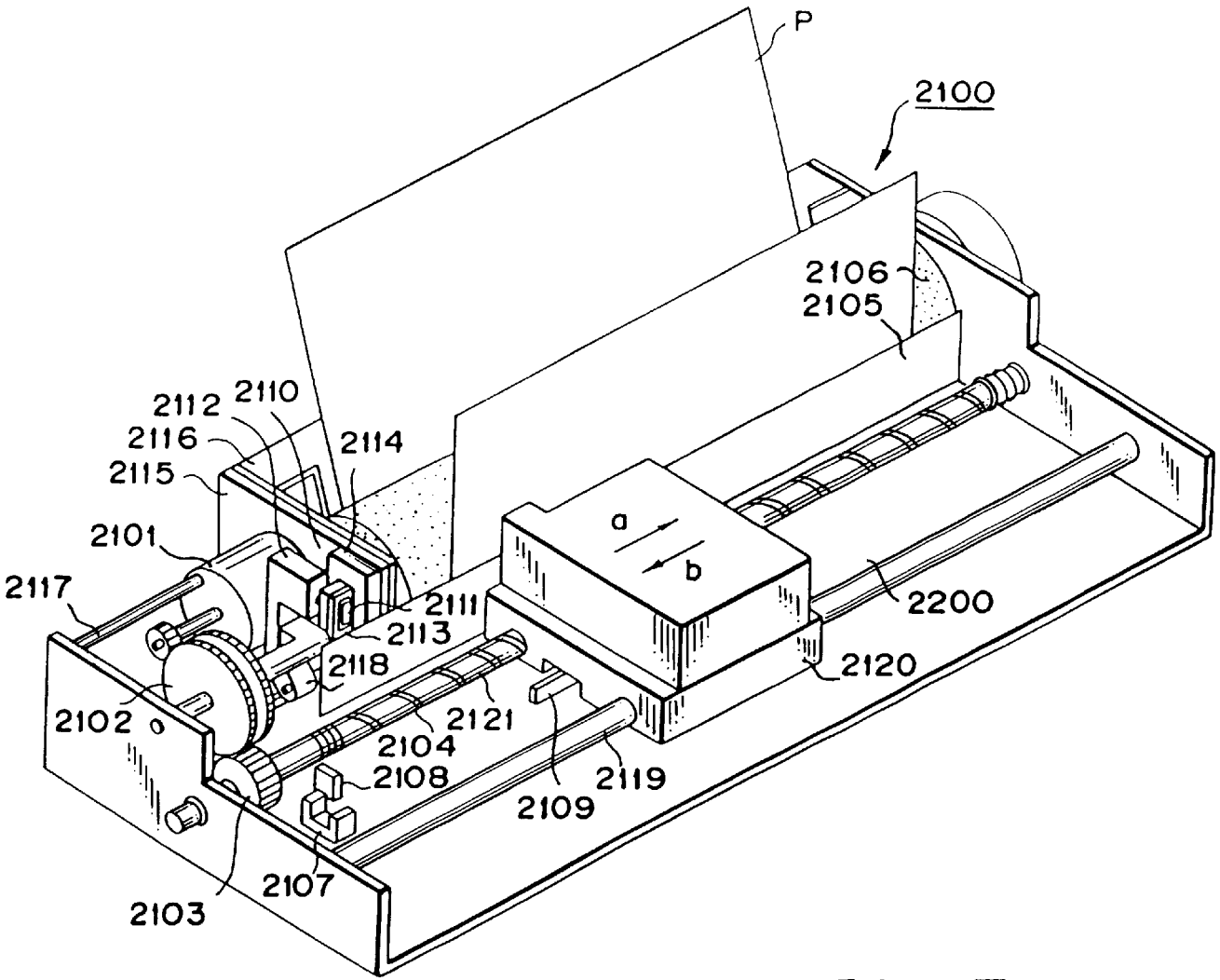
FIG. 17 is a diagrammatic perspective view showing one example of an ink-jet printing apparatus employing a printing head according to the invention.

Next, one example of an ink-jet printing apparatus employing the printing head according to the present invention will be discussed with reference to FIG. 17. FIG. 17 is a schematic perspective view showing one example of the ink-jet printing apparatus, to which the present invention is applied.

The printing head 2200 is mounted on a carriage 2120 engaging with spiral groove 2121 of a lead screw 2104 driven to rotate via driving force transmission gears 2102 and 2103 according to forward and reverse revolution of a driving motor 2101. The printing head 2200 is thus driven to reciprocate in the directions of arrows a and b along a guide 2119 together with the carriage 2120 by the driving force of the driving motor 2101. A paper holding plate 2105 for a printing paper P transported over a platen 2106 by not shown printing medium feeding apparatus fixes the printing paper P on the platen 2106 over the carriage shifting direction.

The reference numerals 2107 and 2108 are photo-couplers serving as a home position detecting means for detecting a lever 2109 of the carriage 2120 for switching direction of revolution of the driving motor 2101, 2110 is a support member supporting a capping member 2111 for capping the entire surface of the printing head 2200 set forth above, 2112 is a suction means for sucking the interior space of the capping member 2111 for performing suction recovery of the printing head 2200 via an opening 2113 in the cap, 2114 denotes a cleaning blade, 2115 is a shifting member for shifting the blade in the back and forth direction. These components are supported on a main body support plate 2116. The cleaning blade 2114 is not necessarily the shown configuration but can be of any known configuration.

On the other hand, the reference numeral 2117 is a lever for initiating sucking for suction recovery, which is shifted according to movement of a cam 2118 engaging with the carriage so that the driving force of the driving motor 2101 is controlled by a known transmission means, such as switching of clutch or so forth. A printing control portion for providing a signal for the heating portion provided in the printing head 2200 and for controlling driving of respective mechanism is provided on the main body side of the printing apparatus (not shown).

The ink-jet printing apparatus 2100 constructed as set forth above is adapted to perform printing with reciprocally shifting the printing head 2200 over the entire width of the printing paper P with respect to the printing paper P transported across the platen 2106 by the printing medium feeding apparatus. Since the printing head produced in the method set forth above is employed, high precision and high speed printing becomes possible.

Also, in the ink-jet printing apparatus, an electrical signal providing means for providing electrical signals for making the printing head eject the ink, is provided. Also, as the ink-jet printing apparatus, only in the form for performing typical printing medium, such as printing paper, a textile printing apparatus for performing printing of pattern on a cloth or so forth can be included. In the textile printing apparatus, in order to perform continuous printing for elongated yard goods, the ink-jet printing head employing the heat generating resistor of the present invention which is difficult to cause degradation of printing quality due to significant fluctuation due to breakage of wiring or variation of resistance during printing, is particularly preferred.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Ahough this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated into the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Hereinafter, concrete embodiments of the present invention will be discussed in further detail.

First Embodiment

In the substrate for the ink-jet printing head of FIG. 3, the surface of the substrate was cleaned by plasma cleaning within the same apparatus immediately before layer deposition. The heat accumulating layer was formed by forming $SiO_2$ in a thickness of 1.2 $\mu$m by thermal oxidation method. Also, the heat accumulation layer 104 which also serves as the interlayer insulation layer was formed by depositing SioN in a thickness of 1.2 $\mu$m by the plasma CVD method.

Here, as the resistor layer 104, polycrystalline $TaN_{0.8hex}$ having fine X-ray defection pattern (II) was deposited in a thickness of 1000 Å by way of reactive sputtering method. In the shown embodiment, the $TaN_{0.8hex}$ layer was deposited as the resistor layer under the following condition by the reactive sputtering method. Namely, the reactive sputtering was performed under the condition of 24% of nitrogen gas partial pressure ratio, 7.5 mTorr of total pressure of a mixture gas of argon gas and nitrogen gas, 2.0 kW of sputtering DC power, 200° C. of environmental temperature, and 200° C. of substrate temperature. Since orientation of (100) plane of $TaN_{0.8hex}$ is strong for the peak of X-ray defraction, the plane distance was d=2.55 Å. Also, at 2θ=about 31°, weak defection peak of $TaN_{0.8hex}$ (001) was observed.

On the fine polycrystalline $TaN_{0.8hex}$ layer, Al as a conductor for supplying thermal energy for ejecting ink was deposited in the thickness of 5500 Å by sputtering. The Al layer is deposited continuously by sputtering within the same apparatus before taking out to expose to the atmosphere. By this continuous deposition, penetration of impurity and moisture into the resistor layer and Al wiring can be successfully prevented. Furthermore, tight contact between both layers can be ensured to make it possible to form highly reliable base body for the printing head.

Subsequently, the Al layer and $TaN_{0.8hex}$ layer are patterned into predetermined configurations. The heat acting portion 108 is the region where the Al layer above the $TaN_{0.8hex}$ layer was removed.

As the protective layer 106, the first layer protective layer SiN was deposited by plasma CVD method in the thickness of about 1500 Å at 300° C., and subsequently second layer protective layer was deposited by the plasma CVD method in the thickness of about 8500 Å at 350° C. Thus, approximately 1 $\mu$m of SiN was deposited as the protective layer 106. Thereafter, by way of DC sputtering, Ta layer was deposited in the thickness of 2000 Å to form the cavitation resistant layer 107. Thus, the base body is completed.

Here, the layer 103 and the layer 106 are formed by the same plasma CVD apparatus and the layer deposing conditions are controlled at respective of predetermined conditions. Also, the layer 104 and the layer 107 are also formed by the same reactive sputtering layer deposing apparatus with the same Ta target with controlling the layer forming conditions to respective of predetermined conditions to form two kinds of layers. In this way, since the layer deposition apparatus to be used becomes lesser, contamination in the apparatus becomes smaller. Furthermore, since batch opening can be reduced as least as possible, the production process with high yield and high operation efficiency can be established.

Figure 18:
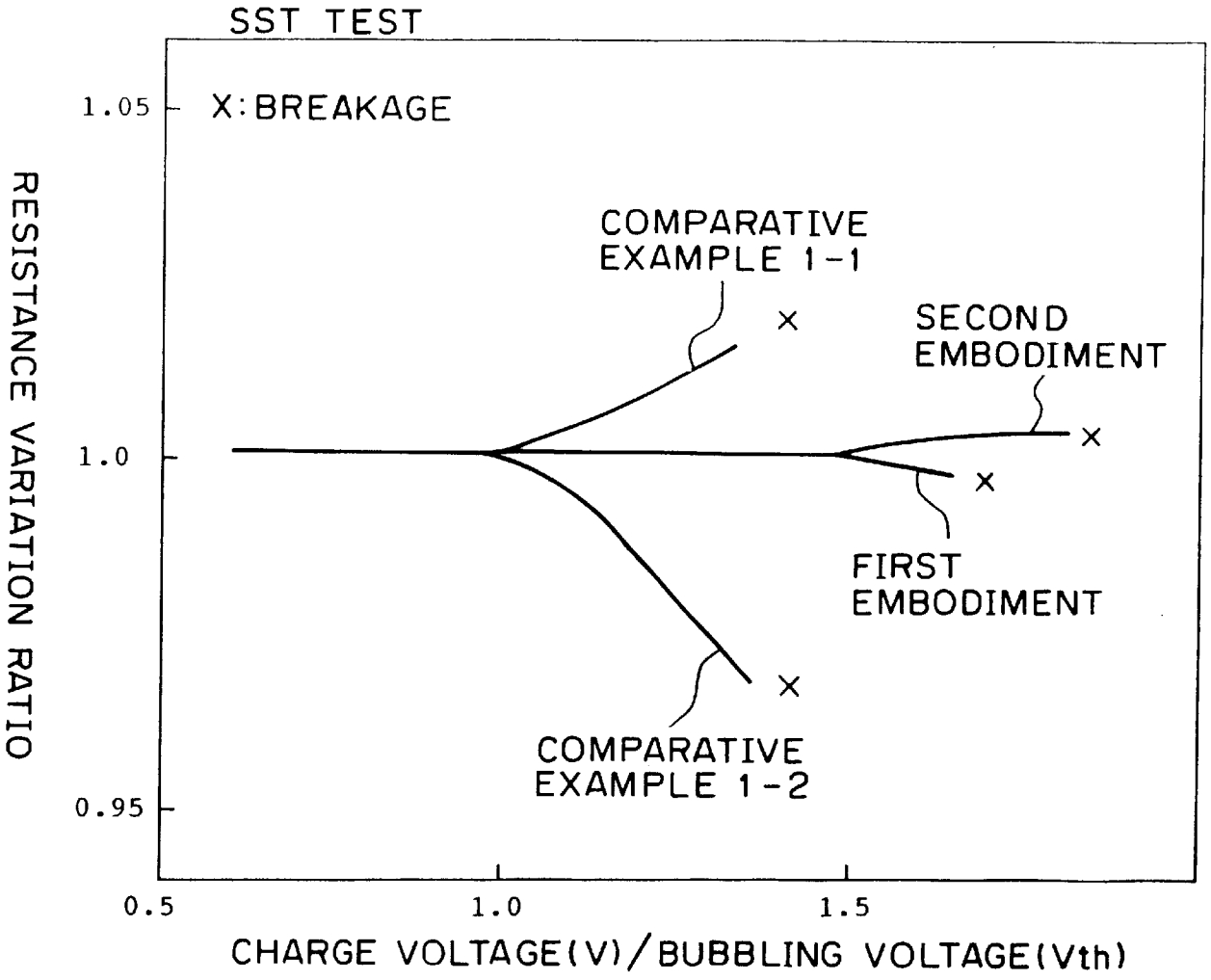
FIG. 18 is a graph illustrating a result of SST test.

FIG. 18 shows a result of an SST test. This SST test was performed by preparing the ink-jet printing head having the resistor layer forming the heat generating resistor to measure the breakdown voltage in the manner set forth above, by providing 7 sec. of rectangular voltage to the electrothermal transducer element as $1\times10^5$ pulses of 2 kHz to measure resistance value with elevating the charged voltage per every 0.05 Vth for measuring variation of resistance until breakage is caused in the electrothermal transducer element. It should be noted that the SST test was performed by applying pulse to the heat generating resistor without performing ink ejection.

The step coverage of the Al electrode by the two layer protective layer in the embodiment 1 is quite good. When fine polycrystalline $TaN_{0.8hex}$ is employed as the heat generating resistor, variation of resistance value the electrothermal transducer element becomes quite small. Also, it is appreciated that the breakdown voltage ratio Kb (Kb= charged voltage/bubbling voltage) is a value of about 1.6 Vth.

Charging of drive voltage to the heat generating resistor at the time where $HfB_2$ becomes to be employed in the base body of the ink-jet printing head as the heat generating body is mainly a single pulse drive only by a main pulse for ejecting ink. However, in the recent years, pulse drive system is changing to so-called double pulse driving by controlling ink ejection amount and applying a subsidiary pulse for the purpose of heating for adjustment of the head temperature.

Conventionally, driving voltage of the single pulse is set between 1.1 Vth to 1.2 Vth in view of durability of the heat generating resistor.

On the other hand, the double pulse driving consisted of the main pulse, subsidiary pulse and resting period therebetween. For example, when the ejection amount is reduced under low temperature, the ejection amount is increased for stable image quality by performing adjustment for setting the subsidiary pulse width longer or so forth. As a result, converting charge energy into the charge voltage upon single pulse, the drive voltage of 1.3 Vth at the maximum is present. Namely, by establishing double pulse, the charge energy to the heat generating resistor is getting higher.

Figure 19:
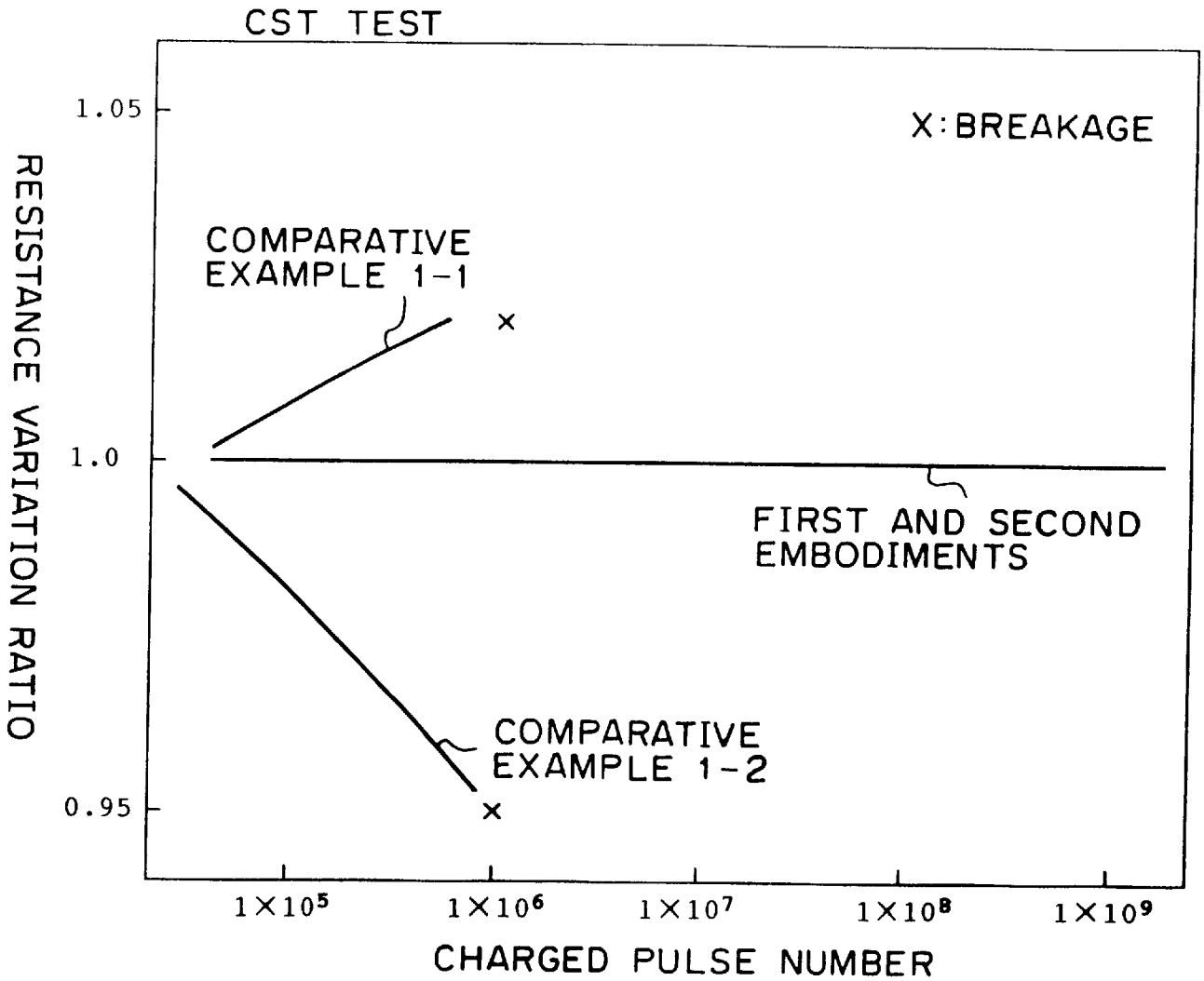
FIG. 19 is a graph illustrating a result of CST test.

Thus, result of heat pulse endurance test (CST test) at 1.3 Vth as the maximum drive voltage is shown in FIG. 19. The CST test is performed only by charging pulse to the heat generating resistor and ink is not contained in the printing head.

From the result of experiment, the electrothermal transducer element employing the protective layer in two layers in the present invention, is found to have substantially 0% of resistance variation.

Figure 20:
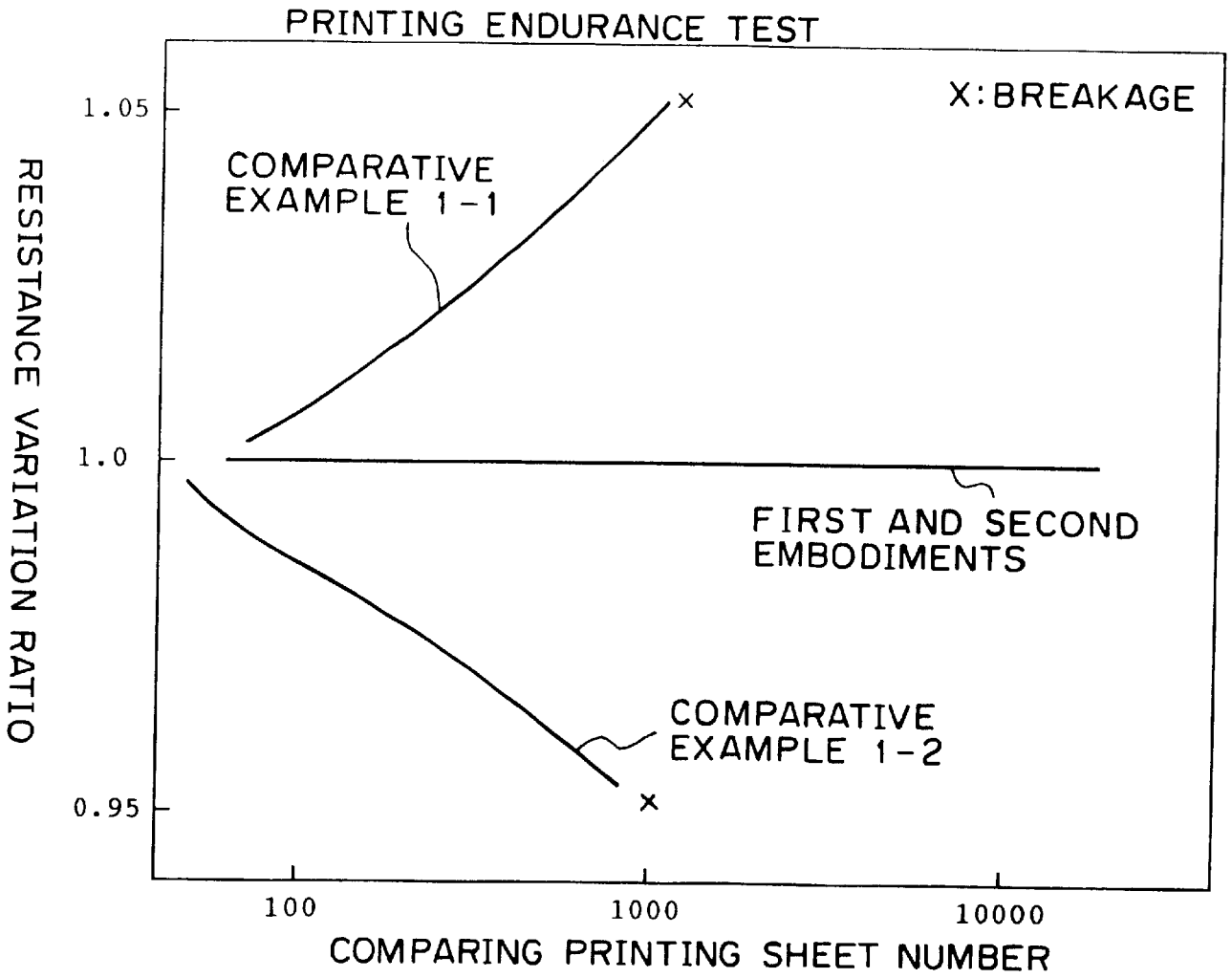
FIG. 20 is a graph illustrating a result of printing durability test.

A head having the heat generating resistor of the first embodiment is prepared, and printing endurance test is performed by installing the head on an apparatus which is constructed by modifying BJ1OV (Canon Kabushiki Kaisha; tradename) as the ink-jet printing apparatus. The result of printing endurance test is shown in FIG. 20. The test is performed by printing a test printing pattern built-in the BJ1OV on a paper of A4 size. As the ink, an ink in the ink cartridge employed in the BJ1OV is used as is. In this case, the drive voltage was 1.3 Vth.

The head employing two layer protective layer in the first embodiment has 0% of resistance variation similar to the CST test and shows good durability.

Second Embodiment

As the protective layer 106 of the ink-jet printing head, the first protective layer SiN was deposited in the thickness of about 1500 Å at 300° C., and then second protective layer SiN was deposited in the thickness of about 8500 Å at 350° C. to form the base body having the protective layer in the thickness of 1 μm in total. With employing this base body, the ink-jet printing head was prepared. Other layer construction and layer deposition method are similar to that of the first embodiment.

In FIG. 18, the result of SST test performed with employing the second embodiment of the ink-jet printing head. The condition of the SST test is similar to that in the first embodiment.

It is found that the second embodiment shows good value of the breakdown voltage Kb of 1.8 Vth.

The result of CST test is shown in FIG. 19. The condition of the CST test is also similar to that of the first embodiment.

Similarly to the first embodiment, the result shows that variation of the resistance value is little in the second embodiment.

FIG. 20 shows a result of printing endurance test employing modified BJ1OV similarly to the first embodiment, but employing the second embodiment of the ink-jet printing head.

The second embodiment demonstrates good result having substantially 0% variation of the resistance value of the resistor later, similarly to the first embodiment.

Comparative Example

The ink-jet printing head prepared (1) by forming the base body with depositing the protective layer SiN of the second embodiment in the thickness about 1 μm at 200° C. by way of plasma CVD method, as a comparative example 1-1, and (2) by forming the base body with depositing the protective layer SiN of the second embodiment in the thickness about 1 μm at 350° C. by plasma CVD method, as a comparative example 1-2.

Results of the SST test was performed by using the electrothermal transducer element employing the resistor layers of respective of the comparative examples 1-1 and 1-2. The test was performed in the same manner to that for the first and second embodiments.

In the comparative example 1-1, the protective layer SiN is loose to cause corrosion of the Al wiring by alkaline ink through pin hole to cause increasing of the resistance value and lower the breakdown voltage to 1.3 Vth.

In the comparative example 1-2, since hillock is grown on the Al during layer formation of the protective layer SiN at high temperature, shorting is caused with the cavitation resistant layer Ta to reduce resistance value, and lower the breakdown voltage to 1.3 Vth.

FIG. 19 shows the results of CST test. The test was performed in the same manner to the foregoing first and second embodiments.

In the comparative example 1-1, the resistance value is increased and in the comparative example, the resistance value is decreased. In both case, breakage was caused at the pulse in the order of $1\times10^6$.

FIG. 20 shows the results of printing endurance test by employing the ink-jet printing heads of the comparative examples 1-1 in the modified BJ1OV as used for the first and second embodiments. Other conditions are the same as those for the first and second embodiments.

The comparative example 1-1 causes ejection failure due to breakage of the Al electrode by corrosion by the ink during the printing endurance test.

The comparative example 1-2 causes ejection failure due to breakage of the Al electrode by shorting between the hillock in the Al electrode and the Ta layer during the printing endurance test.

From the results set forth above, the first and second embodiments of the ink-jet printing heads are found to be suitable for expansion of lift and for higher image quality for superior printing image quality and durability.

On the other hand, the ink-jet printing heads of the comparative examples causes variation of the resistance value to cause clear lowing of the printing image quality. Also, in the light of the durability of the printing head, the first and second embodiments are found superior.

As set forth above, the present invention achieves the effects summarized as follows.

In the ink-jet printing head according to the present invention, the heat generating resistor has little fluctuation of the resistance even after use for a long period and thus achieved long life and high reliability. The ink-jet printing head employing the base body for the ink-jet printing head having such heat generating resistor can be perform high quality printing with stable ink ejection even when repeated printing in the printing system where a preparatory pulse is applied before the main pulse for ejecting ink, as the drive signal for the head, is performed for a long period.

The ink-jet printing head according to the present invention has the stacked structure of the base body for the ink-jet printing head to certainly provide tight fitting ability between the layers and has sufficient durability against repeatedly acting thermal pulse and impact force and can constantly provide desired ink ejection even in repeated use for a long period.

The base body for the ink-jet printing head in the ink-jet printing head according to the present invention is constantly supplied the component material stably. Also, in production of the heat generating resistor, harmful influence, such as contamination by impurity will never be caused. On the other hand, the heat generating resistor has high-reliability, and even in the driving method controlling ink ejecting condition by the double pulse including the main pulse and the subsidiary pulse, which will become major, sufficient durability can be achieved.

The heat generating resistor of the base body for the ink-jet printing head in the ink-jet printing head according to the present invention can provide high quality printed image for a long period for maintaining desired durability even driven at high frequency.

The heat generating resistor according to the present invention can certainly maintain sufficient durability and high quality image even in the driving method controlling the ejecting condition with a plurality of pulses in high speed driving. On the other hand, corresponding to speeding of the printing speed, increasing of number of nozzles to be employed in the head can be easily achieved to ensure constantly stable and desired ink ejection to constantly and stably form high quality images.

In the production method of the base body for the ink-jet printing head according to the present invention, the base body for the ink-jet printing head having high durability, high strength against repeatedly applied thermal impact, small fluctuation of resistance value and resistive against ink corrosion or cavitation, and certainly provide high quality printed images for a long period.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiments set out above but to include all possible embodiments which can be embodied within a scope encompassed and equivalents thereof with respect to the features set out in the appended claims.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid ejecting printing head comprising a base body, in which an electrothermal transducer element is driven on the basis of a double pulse composed of a main pulse, a subsidiary pulse and a resting period therebetween, to generate thermal energy to be used for ejection of a liquid, a driving functional element for driving said electrothermal transducer element, a wiring electrode connecting said driving functional element and said electrothermal transducer element, and an insulative protective layer provided on a component selected from the group consisting of said electrothermal transducer element and said wiring electrode are formed on a substrate, wherein said protective layer is made of SiN, and formed of an insulative compound, said insulative compound having a density that increases gradually from a side close to said substrate to a side remote from said substrate, so that a resistance variation of said electrothermal transducer is suppressed, and wherein said electrothermal transducer is made of $TaN_{0.8}$ hex.

2. A liquid ejecting printing head as claimed in claim 1, wherein said electrothermal transducer element includes a heat generating resistor made of TaN, said TaN containing an amount in the range of 1.9 to 1.0 of Ta relative to 1.0 of N in molecular weight ratio.

3. A liquid ejecting printing head as claimed in claim 1, wherein said electrothermal transducer element includes a heat generating resistor made of $HfB_2$, Poly-Si, Ta—Al, Ta—Ir, Au or Ag.

4. A production method of a base body for a liquid ejecting printing head, said base body including an electrothermal transducer element which is driven on the basis of a double pulse composed of a main pulse, a subsidiary pulse and a resting period therebetween, to generate thermal energy to be used in liquid ejection, a driving functional element driving said electrothermal transducer element, a plurality of wiring electrodes for connecting said driving functional element and said electrothermal transducer element, and an insulative protective layer provided on a component selected from the group consisting of said electrothermal transducer element and said wiring electrodes, all formed on a substrate, the method comprising the steps of forming a protective layer by depositing an insulative material made of SiN over said component selected from the group consisting of said electrothermal transducer element made of $TaN_{0.8}$ hex and said wiring electrodes, while gradually increasing density of said insulative material from a side close to said substrate to a side remote from said substrate, and concurrently elevating a temperature of said base body, so that a resistance variation of said electrothermal transducer is suppressed.

5. A production method as claimed in claim 4, wherein the temperature elevation step is performed discontinuously.

6. A production method as claimed in claim 4, wherein the temperature elevation step is performed continuously.

7. A production method of a base body of a liquid ejecting printing head comprising the steps of forming a first protective layer of a low density insulative compound by depositing an insulative material made of SiN on a component selected from the group consisting of an electrothermal transducer element made of $TaN_{0.8}$ hex which is driven on the basis of a double pulse composed of a main pulse, a subsidiary pulse and a resting period therebetween, to generate thermal energy to be used in liquid ejection, and a wiring electrode at a temperature of 200° C. to 300° C. of said base body, and subsequently forming a second protective layer of a high density insulative compound by depositing an insulative material on said electrothermal transducer element or said wiring electrode at a temperature of 350° C. to 400° C. of said base body, so that a resistance variation of said electrothermal transducer is suppressed.

8. A production method as claimed in claim 7, wherein said steps of forming said first protective layer and said second protective layer are performed by a plasma CVD method.

9. A production method as claimed in claim 7, wherein said steps of forming said first protective layer and said second protective layer include selecting a material from the group consisting of SiN, SiO, $SiO_2$, SiON, PSG, BSG, BPSG, $ZrO_2$, $Al_2O_3$, SiC, Si and $Ta_2O_5$.

10. A production method as claimed in claim 7, wherein said steps of forming said first protective layer and said second protective layer are performed by a sputtering method.

11. A production method as claimed in claim 4 or claim 7, wherein said method comprising the steps of forming a P-type semiconductor layer by epitaxial growth on a P-type semiconductor substrate, and subsequently forming an NPN transistor as said driving functional element on said P-type semiconductor.

12. A production method of a liquid ejecting printing head comprising the steps of:

preparing a base body, said base body comprising an electrothermal transducer element which is driven on the basis of a double pulse composed of a main pulse, a subsidiary pulse and a resting period therebetween, to generate a thermal energy to be used in liquid ejection, a driving functional element driving said electrothermal transducer element, a wiring electrode connecting said driving functional element and said electrothermal transducer element, and a protective layer provided on a component selected from the group consisting of said electrothermal transducer element made of $TaN_{0.8}$ hex and said wiring electrode, formed on a substrate;

forming said protective layer by depositing an insulative material made of SiN on said selected component, while gradually increasing density of said insulative material from a side close to said substrate to a side remote from said substrate, and concurrently elevating a temperature of said base body, so that a resistance variation of said electrothermal transducer is suppressed; and forming an ink ejecting portion having an ejection opening for ejecting an ink.

13. A production method as claimed in claim 10, wherein said deposition step includes depositing the insulative material on said selected component by discontinuously elevating the temperature of the base body.

14. A production method as claimed in claim 10, wherein said deposition step includes depositing the insulative material on said selected component by continuously elevating the temperature of the base body.

15. A production method as claimed in claim 10, wherein said deposition step includes a step of forming a first protective layer of a low density insulative compound by depositing an insulative material on said selected component at a temperature of 200° C. to 300° C. of said base body, and a step of subsequently forming a second protective layer of a high density insulative compound by depositing an insulative material on said selected component at a temperature of 350° C. to 400° C. of said base body.

16. A production method as claimed in claim 10, wherein said deposition step is performed by a plasma CVD method.

17. A production method as claimed in claim 10, wherein said step of forming said protective layer includes selecting a material from the group consisting of SiN, SiO, $SiO_2$, SiON, PSG, BSG, BPSG, $ZrO_2$, $Al_2O_3$, SiC, Si and $Ta_2O_5$.

18. A production method as claimed in claim 10, wherein said deposition step is performed by a sputtering method.

* * * * *

UNITED STATES PATENT AND TRADEMARK OFFICE

CERTIFICATE OF CORRECTION

PATENT NO. : 6,382,775 B1 
DATED : May 7, 2002
INVENTOR(S) : Masahiko Kubota et al.

It is certified that error appears in the above-identified patent and that said Letters Patent is hereby corrected as shown below:

Title page,
Item [57], ABSTRACT,
Line 12, "sisting" should read -- sisting of --.

Column 2,
Line 45, "later" should read -- layer --.

Column 4,
Line 30, (as counted from top line of Column 4), "followings" should read -- following --;
Line 34, "heating resistor body provided" should read -- heat acting portion provided in --;
Line 35, "FIG. 3" should read -- FIG. 3, --;
Line 36, "is" should read -- or is --;
Line 39, "head" should read -- heat --;
Line 65, "portion to be" should read -- portions --; and
Line 66, "placed, are" should read -- are --.

Column 5,
Line 43, "consisting" should read -- making up the --.

Column 6,
Line 12, "SiO2" should read -- $SiO_2$ --;
Line 52, "These" should read -- The --; and
Line 54, "insufficient to remain a large amount" should read -- insufficient, so that a large amount remains --.

Column 7,
Line 3, "having" should read -- has --;
Line 11, "by" should read -- caused by --; and
Line 18, "for" should be deleted.

Column 8,
Line 66, "whereby" should read -- was --.

Column 9,
Line 6, "SioN" should read -- SiON --;
Line 7, "PSG" should read -- BSG --; and
Line 29, "head" should read -- heat --.

UNITED STATES PATENT AND TRADEMARK OFFICE

CERTIFICATE OF CORRECTION

PATENT NO. : 6,382,775 B1
DATED : May 7, 2002
INVENTOR(S) : Masahiko Kubota et al.

It is certified that error appears in the above-identified patent and that said Letters Patent is hereby corrected as shown below:

Column 10,
Lines 32 and 36, "region" should read -- regions --.

Column 11,
Line 8, "SiO2," should read -- $SiO_2$, --;
Line 20, "provided" should read -- provided. --; and
"namely," should read -- Namely, --;
Line 32, "3OK" should read -- 30º --; and
Line 61, "method that" should read -- method is carried out, such that --.

Column 12,
Line 35, "contribute" should read -- contributing --.

Column 14,
Line 30, "deposing" should read -- depositing --; and
Line 37, "H2" should read -- $H_2$ --.

Column 17,
Line 55, "SioN" should read -- SiON --;
Line 58, "defection" should read -- diffraction --.

Column 18,
Line 2, "defraction" should read -- diffraction --;
Line 3, "defection" should read -- diffraction --;
Lines 29 and 32, "deposing" should read -- depositing --;
Line 38, "as least as" should read -- to the least extent --; and
Line 56, "the" should read -- of the --.

Column 19,
Line 47, "method" should read -- methods --; and
Line 50, "head" should read -- head is shown --.

Column 20,
Line 50, "lowing" should read -- lowering --; and
Line 60, "be" should be deleted.

UNITED STATES PATENT AND TRADEMARK OFFICE

CERTIFICATE OF CORRECTION

PATENT NO. : 6,382,775 B1
DATED : May 7, 2002
INVENTOR(S) : Masahiko Kubota et al.

It is certified that error appears in the above-identified patent and that said Letters Patent is hereby corrected as shown below:

Column 21,
Line 11, "high-" should read -- high --;
Line 32, "having" should read -- has --;
Line 34, "value and resistive" should read -- value, resistant --; and
Line 35, "and certainly" should read -- and the ability to --.

Column 23,
Line 8, "comprising" should read -- comprises --.

Column 24,
Lines 3, 7, 11, 20, 22 and 26, "claim 10," should read -- claim 12, --.

Signed and Sealed this

Twenty-second Day of July, 2003

JAMES E. ROGAN
*Director of the United States Patent and Trademark Office*